US007378212B2

(12) United States Patent
Inagaki et al.

(10) Patent No.: US 7,378,212 B2
(45) **Date of Patent: *May 27, 2008**

(54) IMAGE FORMING METHOD, PHOTORECEPTOR

(75) Inventors: Keiichi Inagaki, Hino (JP); Shigeaki Tokutake, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 316 days.

This patent is subject to a terminal disclaimer.

(21) Appl. No.: 11/173,405

(22) Filed: Jul. 1, 2005

(65) Prior Publication Data

US 2007/0003853 A1 Jan. 4, 2007

(51) Int. Cl.
*G03G 13/08* (2006.01)

(52) U.S. Cl. ..... 430/120.1; 399/252

(58) Field of Classification Search ..... 399/252; 430/120.1

See application file for complete search history.

(56) References Cited

U.S. PATENT DOCUMENTS

| | | | | |
|---|---|---|---|---|
| 5,604,574 | A * | 2/1997 | Matsuura et al. | 430/119.84 |
| 7,022,450 | B2 | 4/2006 | Asano et al. | |
| 2004/0147664 | A1* | 7/2004 | Lee et al. | 524/507 |
| 2004/0190951 | A1* | 9/2004 | Kitani et al. | 399/299 |
| 2005/0019682 | A1* | 1/2005 | Inagaki et al. | 430/58.05 |
| 2005/0037274 | A1* | 2/2005 | Shida et al. | 430/60 |
| 2005/0186494 | A1* | 8/2005 | Inagaki et al. | 430/66 |
| 2006/0148971 | A1* | 7/2006 | Jing et al. | 524/520 |

FOREIGN PATENT DOCUMENTS

| | | |
|---|---|---|
| JP | 03-259268 | 11/1991 |
| JP | 06-089034 | 3/1994 |
| JP | 07-295271 | 11/1995 |
| JP | 08-328287 | 12/1996 |
| JP | 09-026671 | 1/1997 |
| JP | 2001-242657 | 9/2001 |
| JP | 2002-229225 | 8/2002 |
| JP | 2003-241412 | 8/2003 |
| JP | 2003-330229 | 11/2003 |
| JP | 2004-004504 | 1/2004 |
| JP | 2004-021192 | 1/2004 |
| JP | 2004-101814 | 4/2004 |
| JP | 2004-177559 | 6/2004 |

OTHER PUBLICATIONS

A Notice of Refection mailed by JPO on Jan. 29, 2008, in connection with App. No. P2004-157284, 4 pgs.
Translation of Notice of Rejection mailed by JPO on Jan. 29, 2008, 5 pgs.
A Notice of Rejection mailed by JPO on Mar. 11, 2008, in connection with App. No. P2004-271333, 6 pgs.
Translation of Notice of Rejection mailed by JPO on Mar. 11, 2008, 6 pgs.

* cited by examiner

*Primary Examiner*—Hoa Van Le
(74) *Attorney, Agent, or Firm*—Squire, Sanders & Dempsey L.L.P.

(57) ABSTRACT

An image forming method comprising the steps of; forming a latent image by exposing an organic photoreceptor to light, and developing the latent image by a developer containing a toner to form a toner image, wherein the organic photoreceptor has a surface layer comprising a binder and fluororesin fine particles having an average primary particle diameter of not less than 0.02 μm and less than 0.20 μm and a crystallinity of less than 90%, and has a contact angle for water of 90° or more; and toner particles of the toner has a particle diameter below 0.7×(Dp50) being 10 number percents, Dp50 being 50% number particle diameter.

An embodiment may be an organic photoreceptor, which comprises a conductive support; a photosensitive layer provided on the conductive support; and a surface layer containing a binder and a fluorine-containing resin fine particle having a number average primary particle diameter between about 0.02 μm and about 0.20 μm and a crystallinity of less than 90% and a binder resin; wherein a contact angle of the surface layer for water is 90° or more and an absolute value of variation of the contact angle is within 2.2°.

19 Claims, 4 Drawing Sheets

IMAGE FORMING METHOD, PHOTORECEPTOR

BACKGROUND OF THE INVENTION

1. Field of the Invention

The present invention relates to an organic photoreceptor used in the field of an image forming method, a manufacturing method of such an organic photoreceptor, and a process cartridge and an image forming apparatus using this organic photoreceptor.

2. Related Art

In recent years, an organic photoreceptor (hereinafter also referred to as "photoreceptor") has been utilized over an extensive range in the electrophotographic photoreceptor. The organic photoreceptor has advantages over other types of photoreceptor, such as easier development of materials conforming to various types of light sources for exposure ranging from visible light to infrared light, possible selection of materials free of environmental pollution and lower production costs. However, the organic photoreceptor is characterized by poorer mechanical strength, easier deposition of foreign substances, poorer chemical resistance, earlier deterioration of electrostatic characteristics at the time of printing multiple sheets, and susceptibility to scratches on the surface.

To be more specific, an organic photoreceptor is required to have a sufficient resistance (wear resistance) to adhesion of foreign substances on the surface or damages caused by the external mechanical force applied when a toner image formed on the photoreceptor is transferred onto a transfer material such as paper or when toner remaining on the photoreceptor is removed by cleaning.

An art to employing polyarylate resin as a binder of the photoreceptor to improve the resistance of the photoreceptor or adhesion of foreign substances on the surface (Document 1, Japanese Patent O. P. I. 2003-195564).

Though a photoreceptor employing polyarylate resin improves anti-resistant characteristics, it is easy to generate cracks because of its rigidity, and toner particles or paper dusts are easy to adhere in the neighborhood of the damage to form filming once the damage is formed, and it causes easily insufficient image such as non-uniform image or dash marks (comet like small marks).

A method of impregnating the polyarylate resin of the photoreceptor with a fluorine-containing resin minute particles such as polytetrafluoroethylene (PTFE) is known in the prior art to improve the resistance of the photoreceptor to adhesion of foreign substances on the surface or damages so as to dissolve the problem of polyarylate resin (Document 2, Japanese Patent O. P. I. 2003-15326).

The fluorine-containing resin minute particles are apt to coagulate during the process of dispersing or coating of the coating composition when the fluorine-containing resin minute particles are incorporated in the polyarylate resin. Therefore, the surface energy of the photoreceptor is not sufficiently reduced and, as the result, prevent of adhesion of foreign material is not sufficient, dash-marks and cracks are apt to generated.

The art of using fine particles of fluorine-containing resin having a small crystallinity (the half-width of the X-ray diffraction peak: 0.28 or more) and a small diameter has been reported as a method of effectively reducing the friction coefficient on the surface of the photoreceptor to improve the wear resistance (For example, Document 3, Japanese Patent O. P. I. 8-328287).

However, the fluororesin particles tend to be coagulated and the stability of the dispersion is lowered so that the layer having uniform properties is difficultly formed since the spreading ability of the fluororesin fine particle having low crystallinity is larger in a coating dispersion using polyarylate as a binder. Therefore, the adhesion of foreign substances cannot be effectively prevented so that dash marks around the coagulated particles, unevenness of the image caused by scratches and burring of image tend to be caused. Moreover, when the coagulated particles of the fluororesin particles are increased in the surface layer, the coagulation interface of the resin particles tends to be a charge trap so that problems such as formation of a memory image such as transferring memory and increasing of the remaining potential accompanied with repeating use causing lowering in the image density tend to be caused.

On the other hand, recently, the image forming apparatus using electrophotographic system is frequently used as an information device for printing out an image formed by a computer. Accordingly, a copying machine and a printer capable of forming a high quality digital image are demanded. Therefore, a developing means capable of exactly developing the static latent image formed on the organic photoreceptor is required, and the use of a polymerized toner in which the distribution of the toner particles are made to monodispersed state is proposed as one of the above means (Document 4, Tokkai 2002-244336). However, some problems are found that the merit of the toner improved in the particle size distribution cannot be satisfactorily displayed when the static latent image is formed on the organic photoreceptor having roughened surface caused by the formation of the dash mark, unevenness and burring of image since the formation of the static latent image is disturbed and the roughened surface is more clearly reproduced as the toner image, even when the toner capable of exactly reproducing the static latent image is employed.

When fluororesin particles having an average particle diameter of not less than 0.20 μm are contained in the surface layer of the photoreceptor, the sharpness of image is lowered by scattering of the exposing laser light and the mechanical strength tends to be lowered and scratches are formed on the photoreceptor surface by degradation of the physical properties of the layer. Accordingly, a suitable photoreceptor cannot be always obtained.

An object of the invention is to simultaneously improve the anti-adhesion ability to foreign substance and the anti-scratch ability which are consistent from each other, and to provide an organic photoreceptor which has good electrical potential property for a long period and is capable of forming an electrophotographic image with high sharpness. In detail, the object is to provide an organic photoreceptor which has good electrical potential property for a long period and is capable of forming an electrophotographic image with high sharpness by preventing the occurrence of the dash marks, the image unevenness and the image burring by preventing the formation of the toner filming and cracks which tend to be caused by the use of the polyarylate resin binder having high resistivity to scratch on the surface layer of the photoreceptors, and to provide a processing cartridge and an image forming apparatus employing the photoreceptor.

SUMMARY

It is an object of the present invention to provide a new organic photoreceptor, a manufacturing method of such an organic photoreceptor, and a process cartridge and an image forming apparatus using this organic photoreceptor.

An embodiment of the present invention is an image forming method comprising forming a latent image on an organic photoreceptor, developing the latent image with a developer containing toner particles, wherein the organic photoreceptor has a surface layer comprising a binder and fluororesin fine particles having an average primary particle diameter of not less than 0.02 μm and less than 0.20 μm and a crystallinity of less than 90%, and has a contact angle for water of 90° or more; and toner particles of the toner has a particle diameter below 0.7× (Dp50) being 10 number percents, Dp50 being 50% number particle diameter.

The other embodiment is an organic photoreceptor comprising a conductive support, a photosensitive layer provided on the conductive support and a surface layer containing a polyarylate binder and a fluorine-containing resin particle having a number average primary particle diameter between about 0.02 μm and about 0.20 μm and a crystallinity of less than 90%.

DETAILED DESCRIPTION OF THE EXPLANATORY EMBODIMENT

Figure 1:
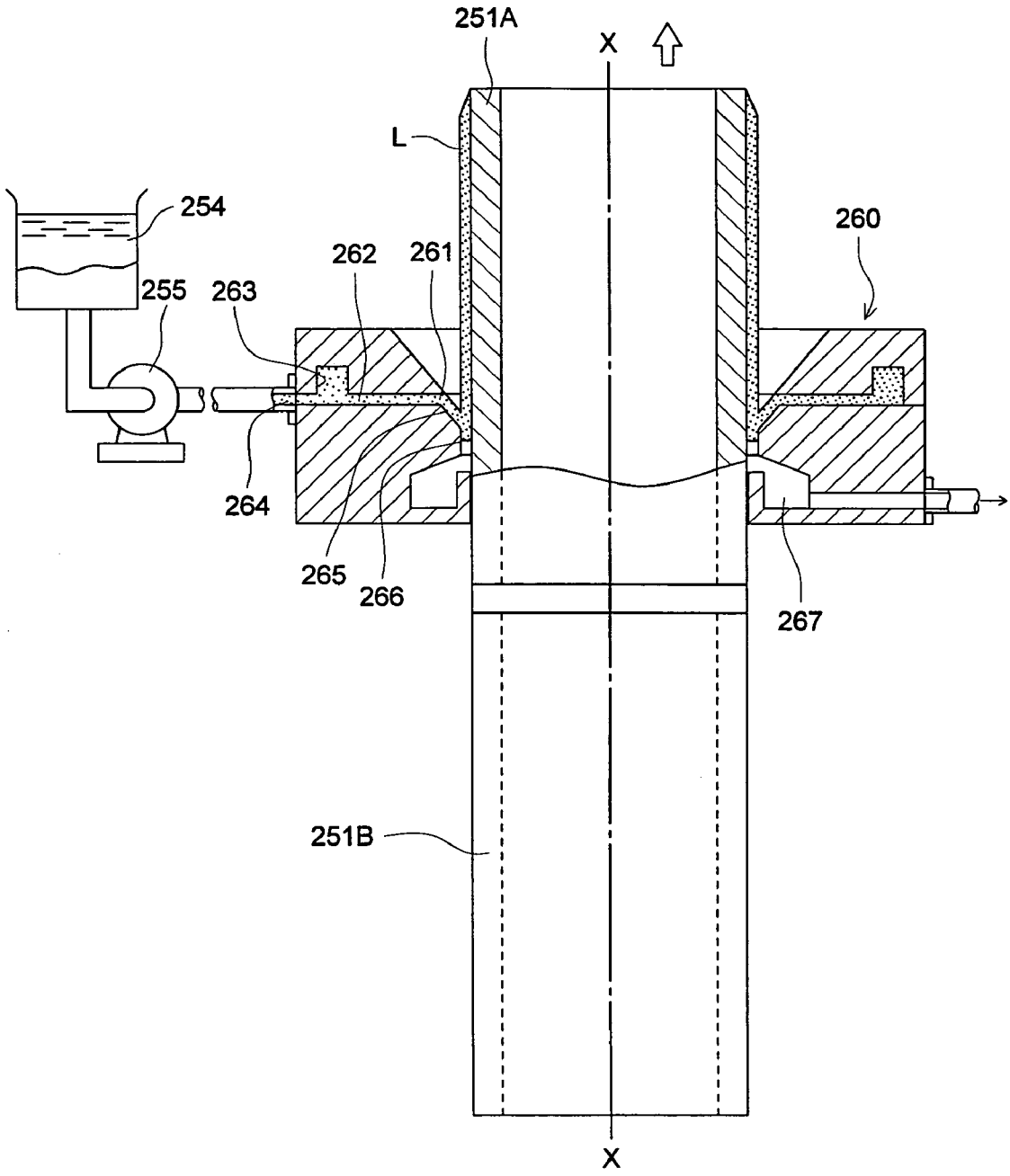
FIG. 1 is a cross sectional view showing an example of a circular type slide hopper coating machine.

An embodiment is concerned with an organic photoreceptor, having a photosensitive layer on the conductive support, comprising a surface layer containing:

fine particles of fluorine-containing resin having a number average primary particle diameter from 0.02 μm inclusive to 0.20 μm exclusive, and a crystallinity of less than 90%.

Surface of the photoreceptor has a contact angle with respect to water is equal to or greater than 90°, and the absolute value of variation of contact angle is within 2.0°.

The surface layer preferably contains a binder. The preferable example of the binder is a polyarylate resin.

Use of the organic photoreceptor can ensure a uniform dispersion property of the fine particles of fluorine-containing resin in the surface layer, thereby improving black spots, uneven image and blurred image that have caused problems on a long-term basis, and forming an electrophotographic image characterized by excellent sharpness. This also provides a process cartridge and image forming apparatus using the organic photoreceptor.

As a binder resin in the above-mentioned surface layer, it is desirable to use a resin which has a surface activity group to help the dispersibility of fluorine-containing resin fine particles in a partial structure of the resin, for example, it is desirable to use polycarbonate and polyarylate which have a siloxane group in a partial structure.

Example of the polyarylate includes a compound containing the following structure.

(1)

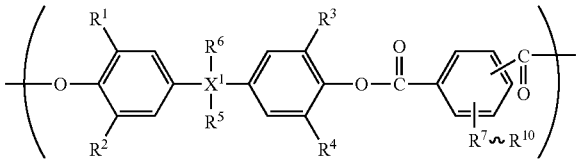

$X^1$ is a carbon atom or a simple bond; $R^1$ through $R^4$ each is a hydrogen or halogen atom, or an alkyl or aryl group which may have a substituent; $R^5$ and $R^6$ each is a hydrogen or halogen atom, or an alkyl or aryl group which may have a substituent, or an alkylidene formed by bonding $R^5$ and $R^6$; $R^7$ through $R^{10}$ is a hydrogen or halogen atom, or an alkyl or aryl group which may have a substituent. The organic photoreceptor comprises polyarylate binder in the surface layer, the example of the polyarylate of Formula (1) is shown.

Po-1

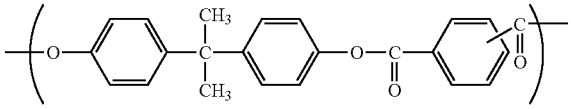

Po-2

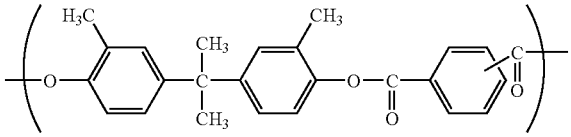

Po-3

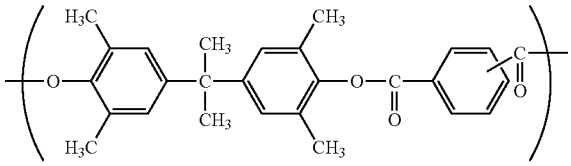

Po-4

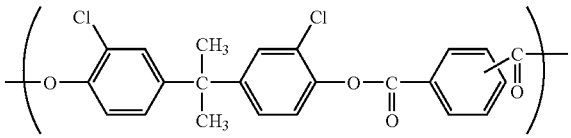

Po-5

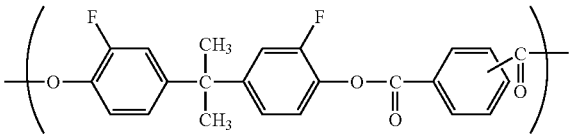

Po-6

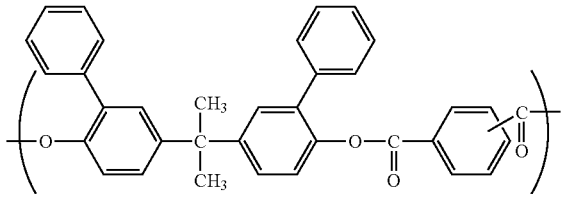

-continued
Po-7
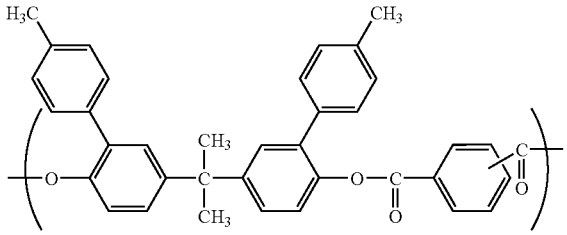
Po-8
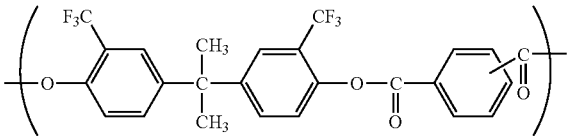
Po-9
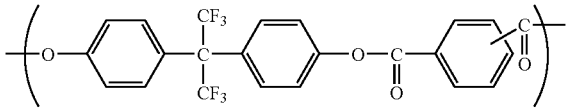
Po-10
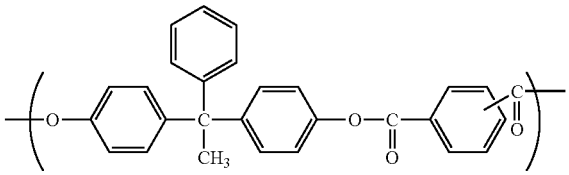
Po-11
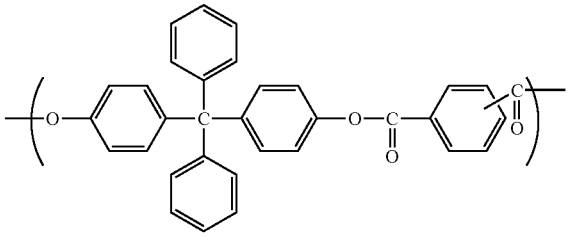
Po-12
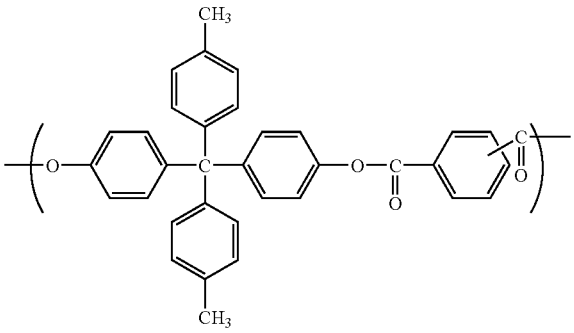
Po-13
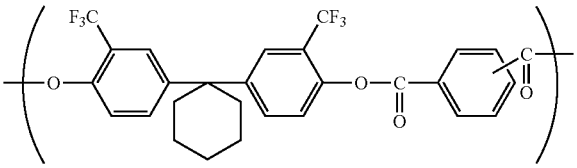
-continued
Po-14
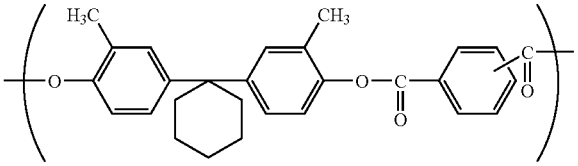
Po-15
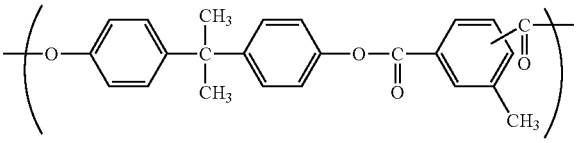
Po-16
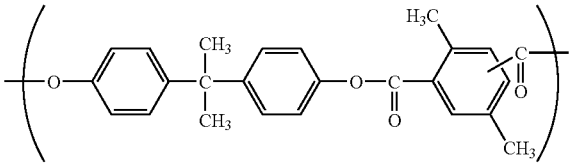
Po-17
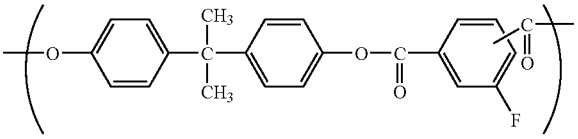
Po-18
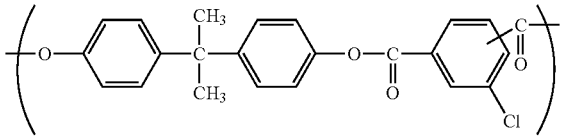
Po-19
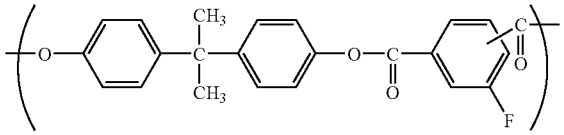
Po-20
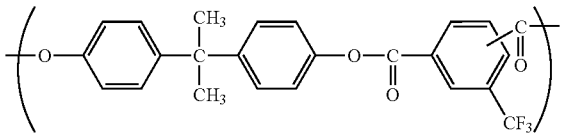

-continued

Po-21

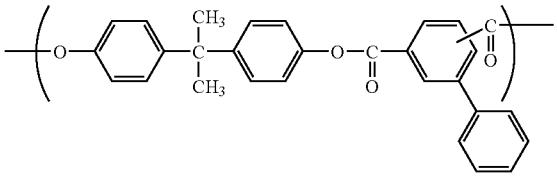

Po-22

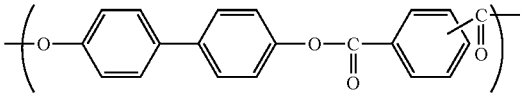

Po-23

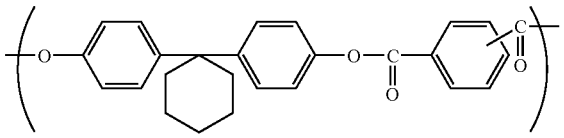

-continued

Po-24

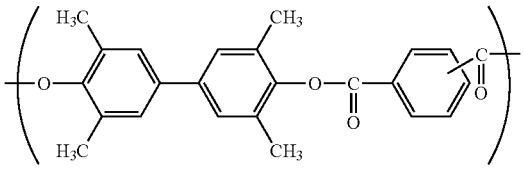

Preferable compounds are Po-1, Po-2, Po-3, Po-10, Po-11, and Po-24, among them.

The polyarylate resin is a homopolymer or copolymer comprising one or more monomer units.

As a binder resin in the above-mentioned surface layer, it is preferable to use, in addition to the polyarylate, a resin which has a surface activity group to help the dispersibility of fluorine-containing resin fine particles in a partial structure of the resin, for example, it is preferable to use polycarbonate and polyarylate which have a siloxane group in a partial structure. Especially, siloxane-modified polycarbonate which has a siloxane group shown below in a partial structure is preferable.

Po-25

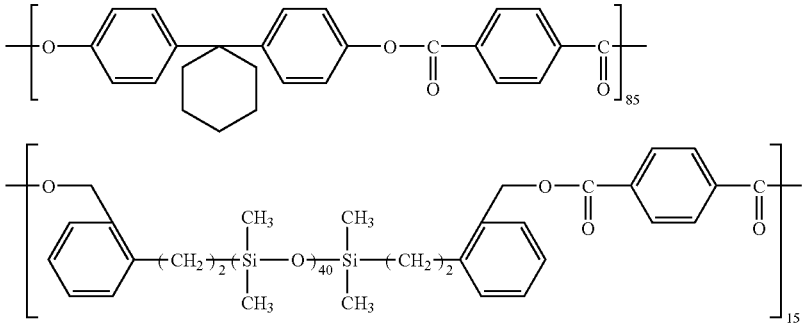

Po-26

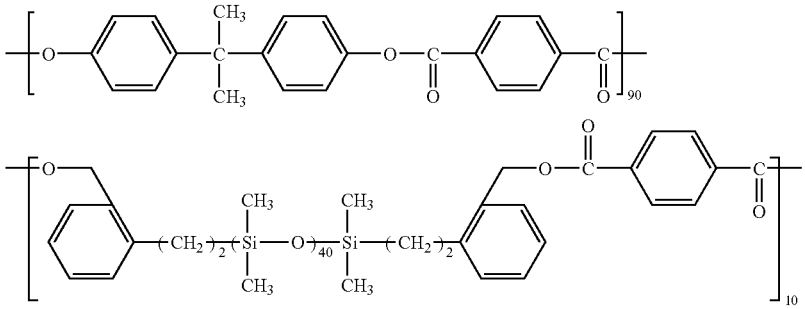

Po-27

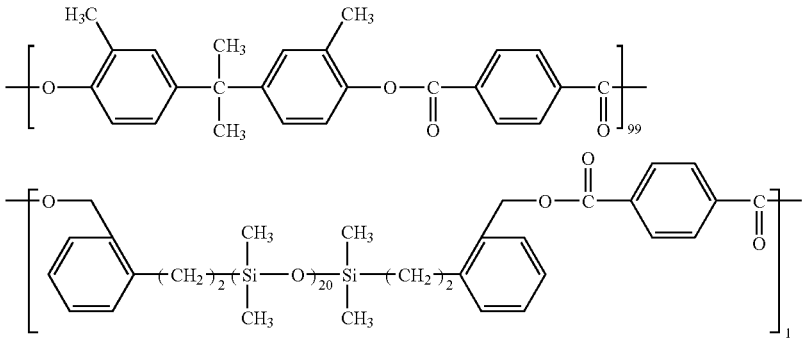

-continued
Po-28
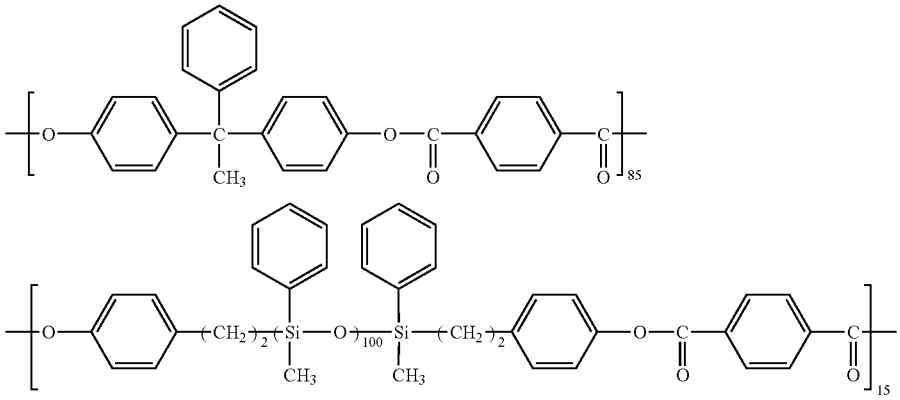
Po-29
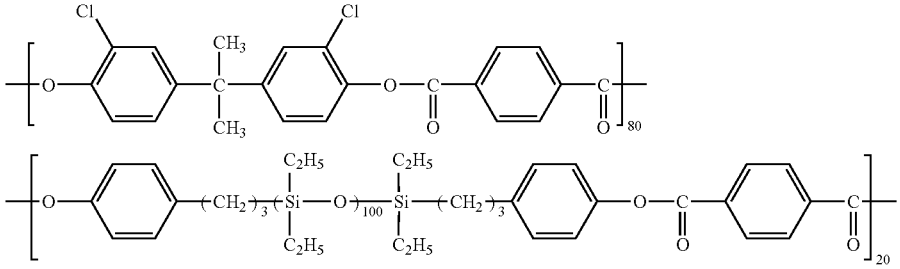
Po-30
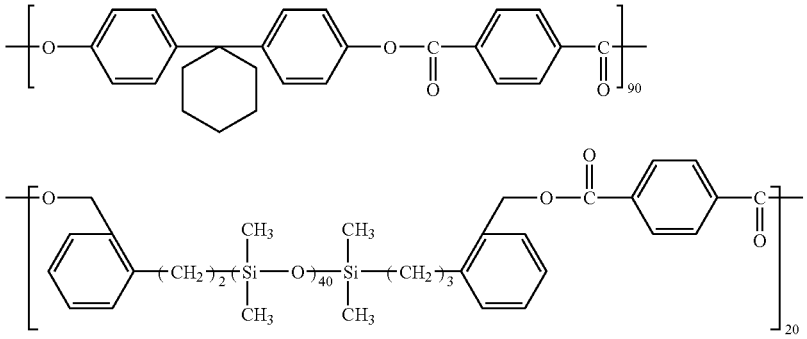
Po-31
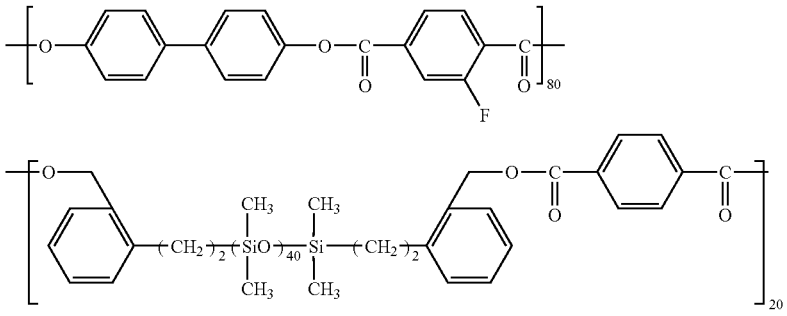
Po-32
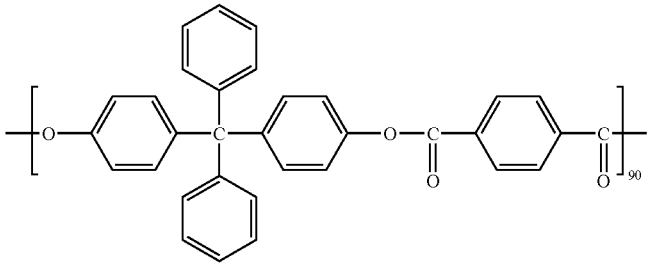

-continued
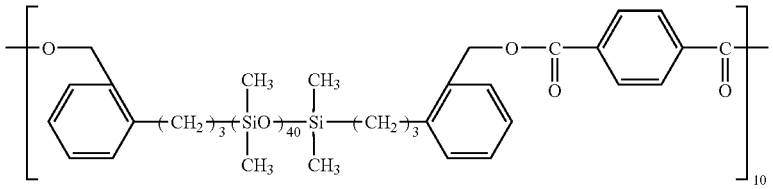
Po-33
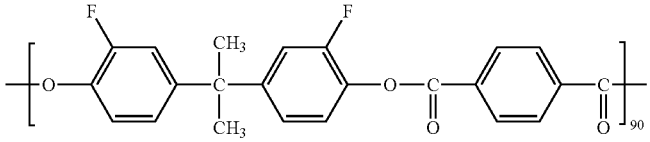
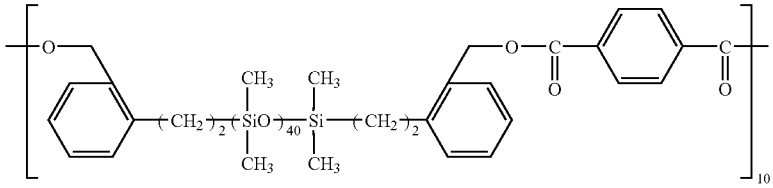
Po-34
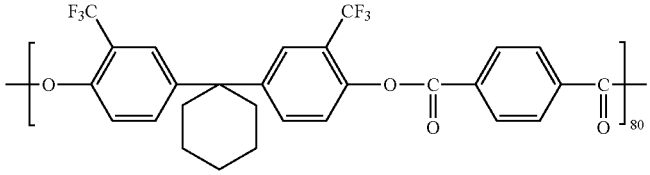
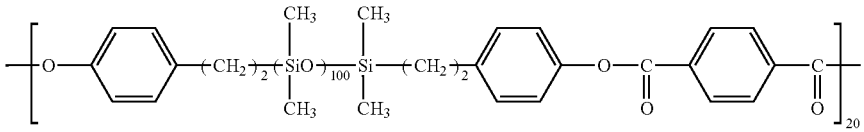
Po-35
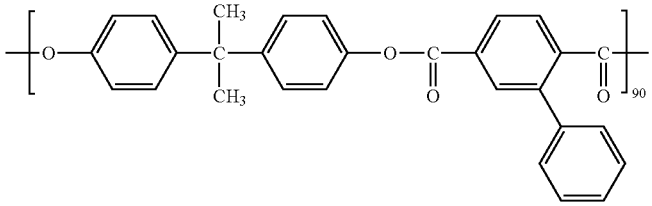
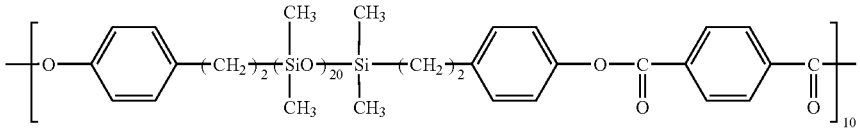

-continued
Po-36
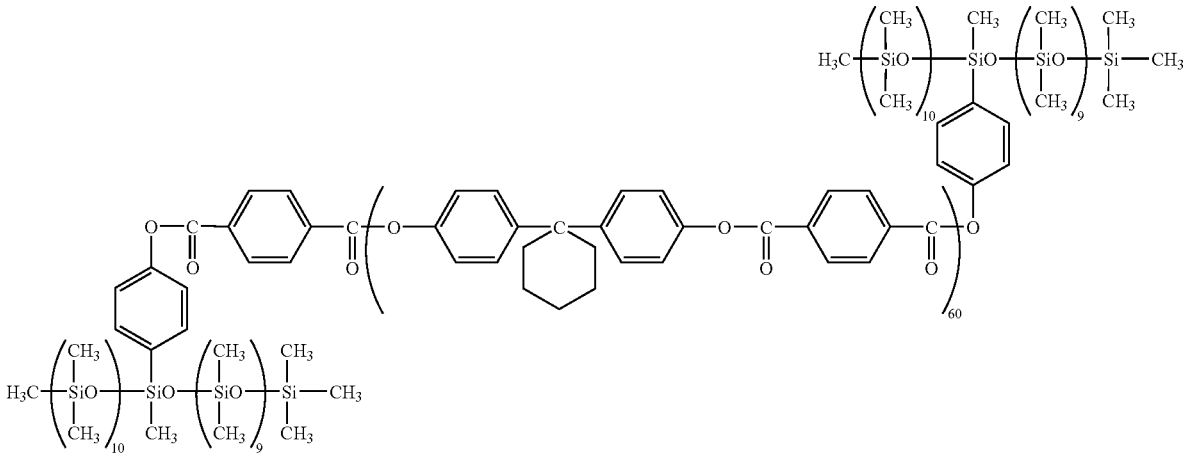
Po-37
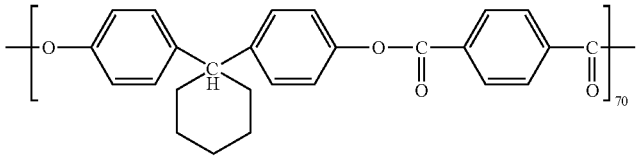
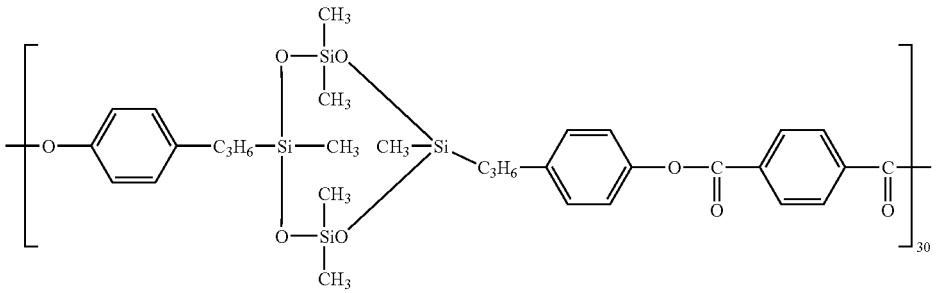
The other examples of the siloxane-modified polycarbonate having partial structure of siloxane group are shown.
(PC-1)
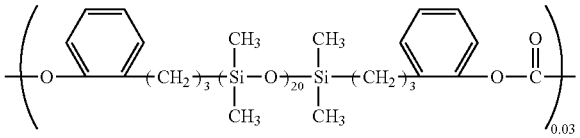
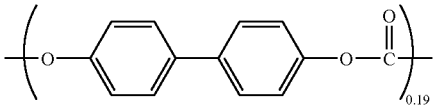
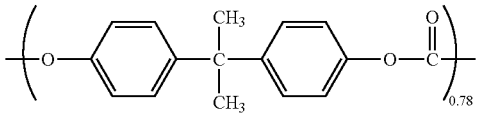
-continued
(PC-2)
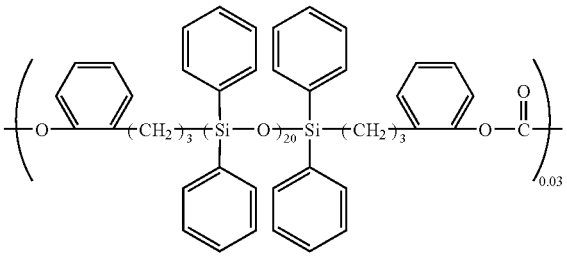
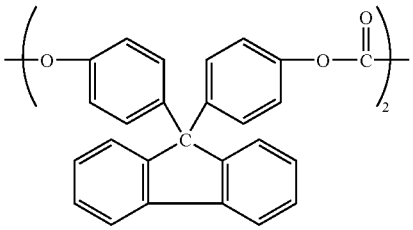

-continued

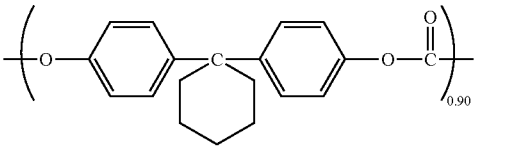

(PC-3)

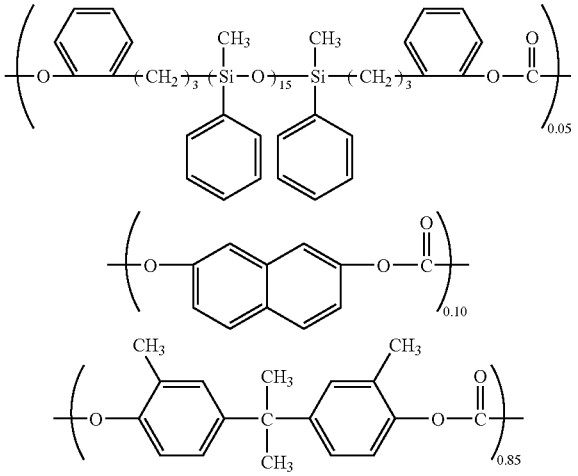

(PC-4)

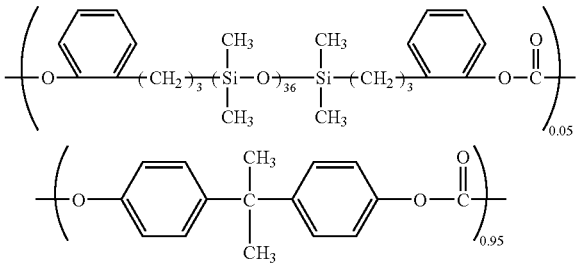

(PC-5)

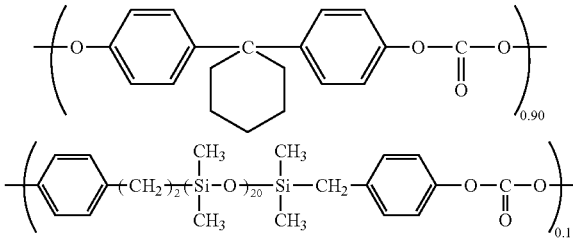

Preferable viscosity average molecular weight of the binder resin, particularly, polyarylate is 10,000-200,00, and more preferably 15,000-120,00.

The photoreceptor comprises fine particles of fluorine-containing resin in the polyarylate binder resin of the surface layer. The fine particles of fluorine-containing resin are by poor dispersion uniformity, and it is difficult to form a uniform and smooth film free of coagula, as described above. Namely, when the fine particles of fluorine-containing resins have a crystallinity of less than 90% and a high degree of spreading property, it is difficult to maintain the dispersed particles of these resins in the dispersion, and to form a surface layer uniform contact angle, due to coagulation of the dispersed particles. The present invention improves the dispersion property of the fine particles of fluorine-containing resin of low crystallinity, having a number average primary particle diameter from 0.02 μm inclusive to 0.20 μm exclusive, and forms the surface layer where the contact angle with respect to water is equal to or greater than 90° and the absolute value of variation of contact angle is within 2.0°. Thus, an organic photoreceptor that can prevent the aforementioned black spots, black streaks or white streaks from occurring for a long period of time, and allows a high-quality electrophotographic image to be formed can be provided.

For the surface layer having the aforementioned properties, the coagulation among fine particles of fluorine-containing resin can be reduced and a stable dispersion can be prepared, by dispersing the fine particles of fluorine-containing resin having a number average primary particle diameter from 0.02 μm inclusive to 0.2 μm exclusive, and a crystallinity of less than 90%, using a solvent having a low boiling point and an excellent dispersion property, preferably an organic solvent having a boiling point not exceeding 120° under the atmospheric pressure (e.g. THF, ethanol, toluene, dichloroethane). At the same time, the surface layer is formed using a coating apparatus of coating composition supply type wherein this dispersion is employed as a coating composition, and the surface is then dried. These steps prevent coagulation of the fine particles of fluorine-containing resin in the surface layer, thereby forming a surface layer characterized by reduced variations in the angle of contact with respect to water.

The aforementioned coating apparatus of coating composition supply type refers to a coating apparatus wherein the coating composition required for layer formation is supplied onto the conductive support for coating operation, and includes a quantity-regulated coating machine and a spray coating machine. Such a coating apparatus of coating composition supply type allows the surface layer to be formed in the one-way operation, as compared to the dip coating method where the conductive support is dipped in the coating composition. The dispersed fine particles of fluorine-containing resin enables a uniform surface layer to be formed wherein there is little coagulation of the fine particles of fluorine-containing resin, without being subjected to coagulation share in the dispersion. Moreover, the dispersion is prepared for each production of the photoreceptor. This avoids coagulation of the dispersion due to secular change and permits coating to be performed at the time of surface layer formation, wherein the lower layer already formed on the conductive support is not dissolved.

The method of coating with a quantity-regulated coating machine is most preferable to the aforementioned coating apparatus of coating composition supply type, when the dispersion using the aforementioned low-boiling point solvent is employed as a coating composition. In the case of a circular photoreceptor, it is preferred to coat it with the circular slide hopper coating machine described in details in the Japanese Patent O.P.I. 58-189061.

The following gives a brief description of the circular slide hopper coating machine.

Figure 2:
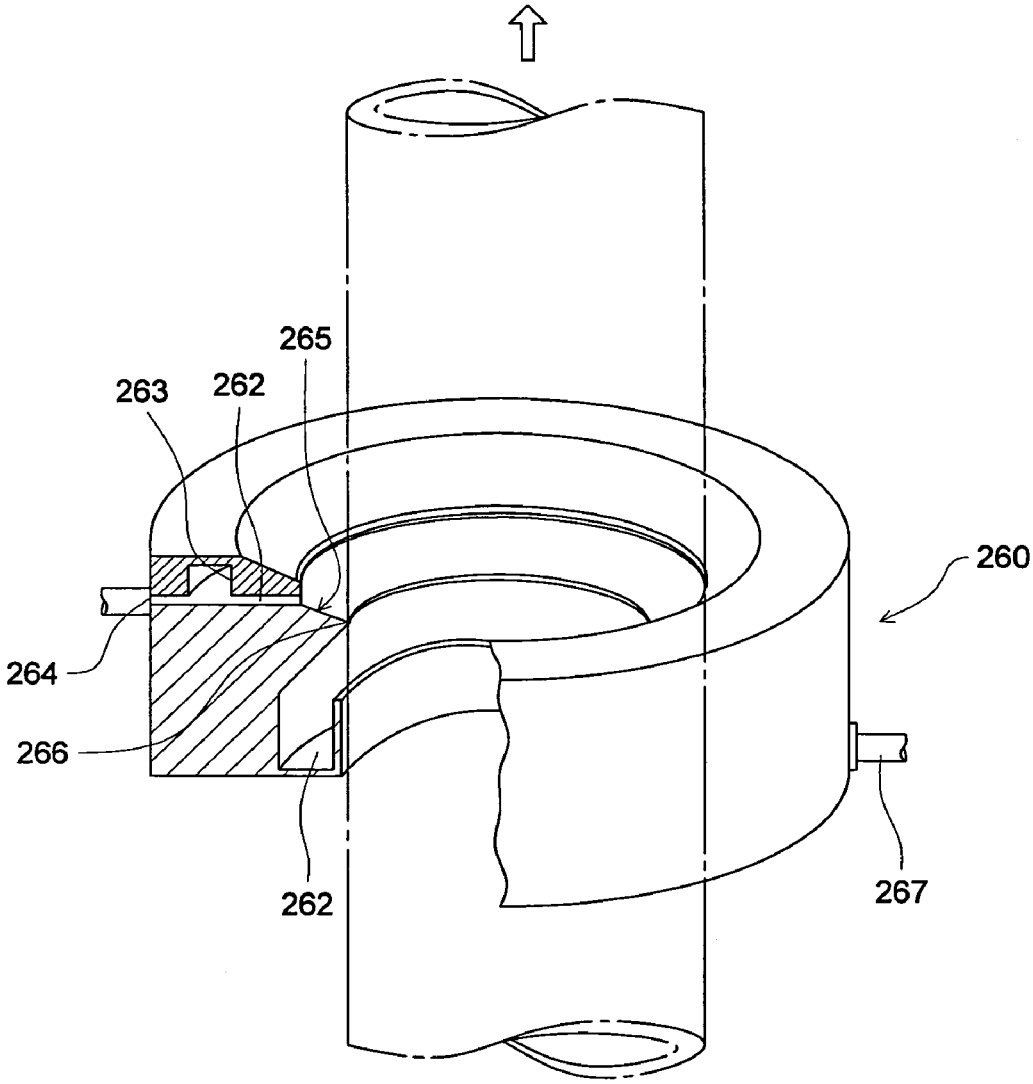
FIG. 2 is a perspective view showing an example of a circular type circular type slide hopper coating machine.

The dispersion with fine particles of fluorine-containing resin dispersed therein can be effectively coated using a circular slide hopper coating machine. In an example of the circular slide hopper coating machine, the cylindrical substrates 251A and 251B arranged one on top of the other in the perpendicular direction along the centerline x are raised in the arrow marked direction on a continuous basis, as shown in the cross sectional view of FIG. 1. Coating composition L is coated by the portion 260 (abbreviated as a coating head), enclosing them, directly involved in the coating operation of a slide hopper type coating machine with respect to the outer peripheral surface of the cylindrical substrate 251. A hollow drum, for example, an aluminum drum and plastic drum, or a seamless belt type substrate can be used as the substrate. As shown in FIG. 2, the coating head 260 is provided with a narrow coating composition distribution slit 262 (abbreviated as a slit) having a coating composition outlet 261 opened toward the substrate 251, wherein this coating composition outlet 261 is formed in the horizontal direction. The slit 262 communicates with an annular coating composition distribution chamber 263, and the coating composition L of a storage tank 254 is put into the annular coating composition distribution chamber 263 by the pressure pump 255. In the meantime, a slide surface 265, having a continuous downward inclination, for forming a end portion having the dimension a little greater than the outer dimension of the substrate, is provided on the lower side of the coating composition outlet 261 of the slit 262. Further, a lip-like portion 266 extending downward from the end portion of this slide surface 265 is provided. In the coating operation by such a coating machine, the coating composition L is pushed out of the slit 262 in the process of lifting the substrate 251 and is made to flow downward along the slide surface 265. Then the photosensitive coating composition having reached the end portion of the slide surface forms beads between the end portion of the slide surface and substrate 251, and is then coated on the surface of the substrate. Excess photosensitive coating composition is discharged from the discharge port 267.

The coating composition is allowed to flow down along slide surface 265, the coating composition forms bead between the end portion of the slide surface 265 and the cylindrical substrate 251A and coated layer is formed on the cylindrical substrate when it reaches at the end portion.

In the aforementioned method of coating with the circular slide hopper coating machine, the slide surface end portion and substrate are arranged with a certain gap of about 2 μm to 2 mm between them, and can be coated with coating composition, without the subject to substrate being damaged, or without the already coated layer being damaged when the multiple layers having different properties are formed. Further, in the formation of a plurality of layers having different properties and dissolvable in the same solvent, the time of staying the solvent is much shorter than that in the dip coating method. This arrangement ensures coating operation to be completed, with the components of the lower layer hardly solving out into the upper layer or coating reservoir.

The fine particles of fluorine-containing resin have a number average primary particle diameter from 0.02 μm inclusive to 0.20 μm exclusive in view of good stability and coating property of the dispersion. Variations in the angle of contact is kept minimum and black spots or black spots on the printed image are minimized by employing the fine particles of fluorine-containing resin having specified particle diameter mentioned above.

The number average primary particle diameter is measured by DLS-6000 manufactured by Otsuka Electronics Co. Ltd., by means of dynamic light scattering method, and can be measured by other means of laser diffraction, centrifugal sedimentation. It can be also measured by observing the cross section of the photoreceptor.

The angle of contact with respect to water is preferably less than 90°, deposits of the inorganic external additives such as silica is minimized, and prevents generation of black spots. Further, frictional drag with the contact member of the photoreceptor such as a cleaning blade are kept small, and the amount of wear will not be increased by fretting, so that streak-like irregularities of the image will not occur and sharpness of the image will be maintained. The more preferred contact angle is 95° or more without exceeding 120°.

The absolute value of variation of contact angle is preferably within 2.0° by uniform dispersion of the fine particles of fluorine-containing resin in the surface layer. Under such condition embedding of inorganic components in the toner or paper powder, for example, inorganic external additives such as silica and titanium oxide in the toner, or the talc component into the surface layer will be prevented, and therefore black spots, black-and-white streaks will not tend to be produced. The absolute value of variation in the contact angle is more preferred to be within 1.7°.

Measurement of contact angle and its variation

The contact angle in the sense is defined as the angle of contact to the surface of a photoreceptor with respect to pure water (at 20° C.). The contact angle of the photoreceptor is obtained by measuring the contact angle with respect to pure water using a contact angle meter (Model CA-DT.A by Kyowa Interface Science Co., Ltd.) at 20° C., 50% relative This measurement was started after repeated image formation of at least several sheets, when the photoreceptor has conformed to the image formation. When the photoreceptor was cylindrical, measurement was carried out at three positions—at the center and 5 cm from the right and left ends, and at four positions at each 90° in the circumferential direction—i.e. at a total of 12 positions. The average of these measurements was assumed as the contact angle, and the values farthest from this average value in the positive and negative directions were assumed as variations. Similarly, when the photoreceptor was a sheet, measurement was carried out at three positions—at the center and 5 cm from the right and left ends, and at four positions at an equally spaced interval—i.e. at a total of 12 positions. The average of these measurements was assumed as the contact angle of the present invention, and the values farthest from this average value in the positive and negative directions were assumed as variations.

The fine particles of fluorine-containing resin have a number average primary particle diameter from 0.02 μm inclusive to 0.20 μm exclusive, and a crystallinity of less than 90%. In case that the crystallinity is 90% or more, preferable dispersion property as well as the spreading property of the fine particles of fluorine-containing resin are obtained, and the absolute value of variation of contact angle are maintained. The crystallinity is preferably 40% or more.

To measure the crystallinity of the fine particles of fluorine-containing resin, the diffraction peak having occurred is separated into crystalline and non-crystalline portions according to wide-angle X-ray diffraction measurement. After baseline correction, the result is expressed in terms of the percentage of the X-ray integrated intensity of the crystalline portion (numerator) over the full X-ray integrated intensity of the crystalline and non-crystalline portions (denominator).

Measurements were made using the following wide-angle X-ray diffraction measuring apparatus under the following measuring conditions. If the same results as those by the wide-angle X-ray diffraction measuring apparatus can be obtained, another measuring instrument can be utilized.

X-ray generator: Rigaku RU-200B
Output: 50 kV, 150 mA
Monochromator: Graphite
Radiation source: CuKα (0.154184 nm)
Scanning range: $3 \leqq 2\theta \leqq 60$
Scanning method: θ-2θ
Scanning rate: 2/min The fluorine-containing resin fine may be a homopolymer or a copolymer of a fluorine-containing polymerizable monomer, or a copolymer of a fluorine-containing polymerizable monomer and a fluorine free polymerizable monomer.

A fluorine-containing polymerizable monomer is shown by a general formula (4);

(4)

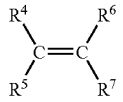

(In the formula, at least one of $R^4$-$R^7$ is a fluorine atom, and the remainings are a hydrogen atom, a chlorine atom, a methyl group, a monofluoro methyl group, a difluoro methyl group, or a trifluoro methyl group independently, respectively). As a preferable fluorine-containing polymerizable monomer, ethylene tetrafluoride, ethylene trifluoride, ethylene chloride trifluoride, propylene hexafluoride, vinyl fluoride, vinylidene fluoride, ethylene dichloride difluoride, etc. may be listed. As a fluorine-containing polymerizable monomer, two or more kinds of monomers may be used.

As a fluorine free polymerizable monomer, vinyl chloride and so on may be listed. As a fluorine free polymerizable monomer, two or more kinds of monomers may be used.

It may be preferable that the fluorine-containing resin fine particles are composed of a homopolymer or a copolymer of a fluorine-containing polymerizable monomer, and it is more preferable to use a poly ethylene tetrafluoride(PTFE), poly ethylene trifluoride, and ethylene tetrafluoride-propylene hexafluoride copolymer and polyvinylidene fluoride, and it may be especially preferable to use poly ethylene tetrafluoride.

The number average molecular weight of a polymer of the fluorine-containing resin fine particles is preferably 10,000 to 1,000,000.

The degree of crystallinity of fluorine-containing resin fine particles changes according to the construction materials of the fluorine-containing resin fine particles, and it is changed also by conducting heat-treating for the fluorine-containing resin fine particles. For example, if PTFE fine particles (polyethylene terephthalate fine particles) whose number average primary particle diameter is 0.12 μm and degree of crystallinity is 91.3 are heat-treated for 65 minutes at 250° C., degree of crystallinity can be reduced to 82.8. A dryer or a heating furnace can be used for heat treatment.

It is preferable to make the ratio of the fluorine-containing resin fine particles in the surface layer high, it is preferable to use it by an amount of at lest more than 20 to 200 parts by weight to 100 parts by weight of the binder resin by a mass ratio to form a surface layer having contact angle for water of 90° or more and dispersion in a contact angle is ±2.0° by using the fluorine-containing resin fine particles, because it is easy to form the surface layer satisfying both conditions that a contact angle for water is 90° or more and an absolute variation in a contact angle is within 2.0°.

Charge transfer compounds represented by the formula (2) and (3) are preferably employed as a CTM. The compound is also preferably employed in the surface layer.

(2)

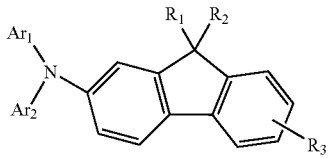

(3)

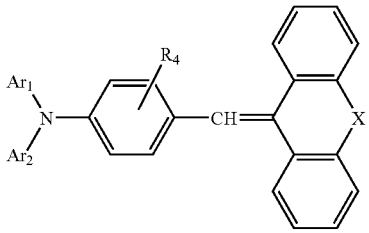

Each of $Ar^1$ and $Ar^2$ is an aryl group which may have a substituent; $R_1$ and $R_2$ each is a hydrogen atom, or an alkyl group, $R_3$ is a hydrogen or halogen atom, or an alkyl group; $R_4$ is a hydrogen or halogen atom, or an alkyl group; X is a vinylene or ethylene group.

There compounds are advantageous in dispersing fluororesin particles to form the surface layer having small variation of contact angle and less adhesion of foreign particles, whereby a photoreceptor having minimized generation of dash marks, image non-uniformity and blur of images, as well as stabilized potential characteristics prohibiting transfer memory.

Practical examples of compound represented by formula (2) are listed.

CT1-1

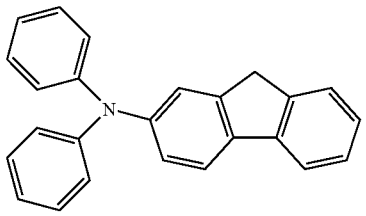

CT1-2

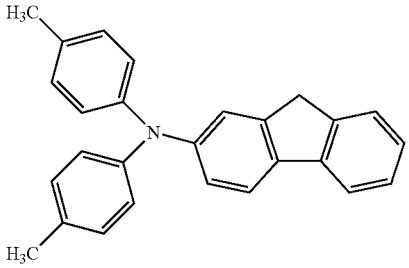

CT1-3

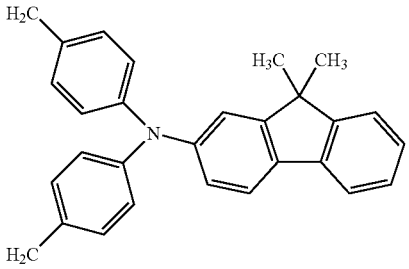

-continued

CT1-4

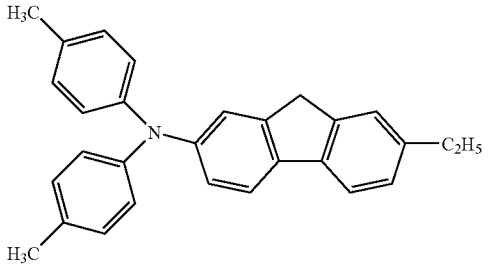

CT1-5

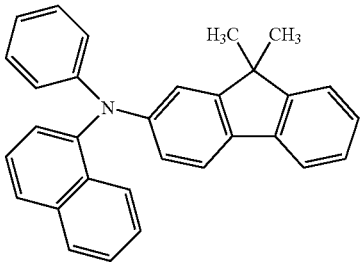

Practical examples of compound represented by formula (3) are listed.

CT2-1

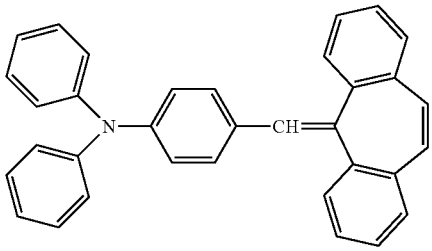

CT2-2

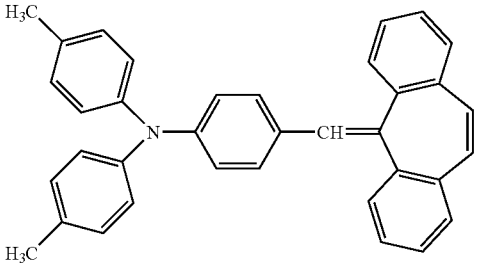

CT2-3

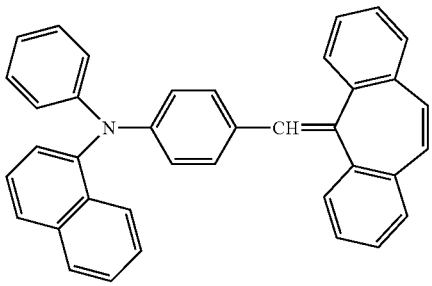

-continued

CT2-4

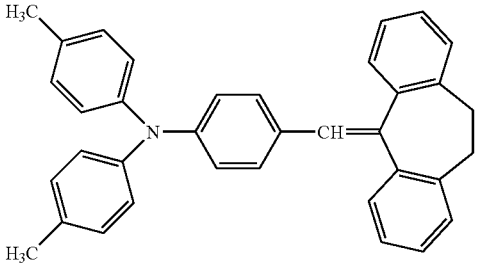

CT2-5

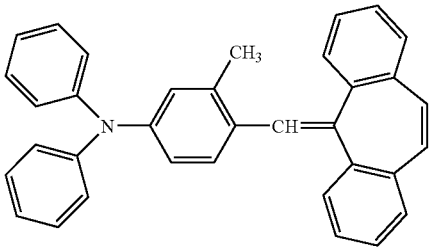

Content of charge transfer material in the surface layer is, with reference to 100 parts by weight of the binder resin, preferably 30-200 parts by weight of the charge transfer material and more preferably 50-150 parts by weight.

The surface layer may preferably contain an anti-oxidant. Further, antioxidants having a partial structure of hindered phenol, hindered amine, thioether, or phosphite may be incorporated into the resin layer of the present invention, and are effective for the improvement of potential stabilization during ambient variation, as well as image quality.

The following compounds are exemplified.

(1) Radical chain inhibitor

Phenol type antioxidant (e.g. hindered phenols) Amine type antioxidant (e.g. hindered amines, diallyl diamines, and diallyl amines)

Hydroquinone type antioxidant (2) Peroxide decomposer

Sulfur type antioxidant (e.g. Thioethers) Phosphor type antioxidant (e.g. Phosphorous esters)

Radical chain inhibitor is preferably employed among compounds referred above. Hindered phenols and hindered amines antioxidants are particularly preferable. Two or more species of the compounds, for example, a combination of a hindered phenol antioxidant and a thioether antioxidant, may be employed. The antioxidants having a partial structure of hindered phenol, hindered amine, thioether, or phosphite may be employed.

Particularly hindered phenol and hindered amine antioxidants are effective for such improvement of preventing occurrence of fogging and blurring of image in high temperature and high moisture condition.

Content of the antioxidant such as hindered phenol or hindered amine is preferably 0.01 to 20 weight % in the resin layer.

The hindered phenols as described herein means compounds having a branched alkyl group in the ortho position relative to the hydroxyl group of a phenol compound and derivatives thereof. The hydroxyl group may be modified to an alkoxy group.

The hindered amines are compounds having a bulky organic group in the neighborhood of a nitrogen atom, wherein an example of the bulky organic group is a branched alkyl group, and for example t-butyl is preferable. Listed as hindered amines are compounds having an organic group represented by the following structural formula:

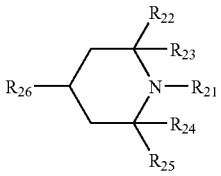

wherein $R_{21}$ represents a hydrogen atom or a univalent organic group, $R_{22}$, $R_{23}$, $R_{24}$, and $R_{25}$ each represents an alkyl group, and $R_{26}$ represents a hydrogen atom, a hydroxyl group, or a univalent organic group.

Listed as antioxidants having a partial hindered phenol structure are compounds described in JP O.P.I. No. 1-118137 (on pages 7 to 14).

Listed as antioxidants having a partial hindered amine structure are compounds described in JP O.P.I.No. 1-118138 (on pages 7 to 9).

Examples of organic phosphor compounds are those represented by a formula of RO—P(OR)—OR, wherein R is a hydrogen atom, an alkyl, alkenyl or aryl group which may have a substituent.

Examples of organic sulfur compounds are those represented by a formula of R—S—OR, wherein R is a hydrogen atom, an alkyl, alkenyl or aryl group which may have a substituent.

Representative antioxidants are listed.

1-1

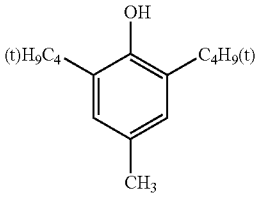

1-2

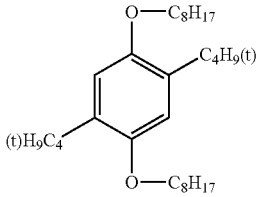

1-3

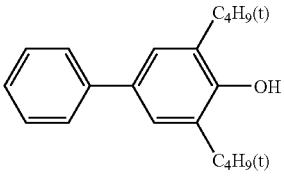

1-4

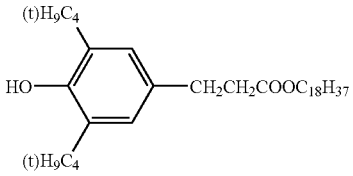

1-5

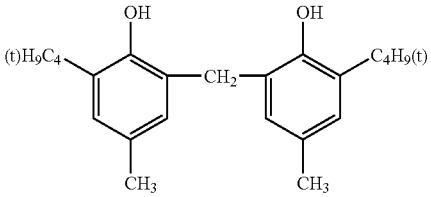

1-6

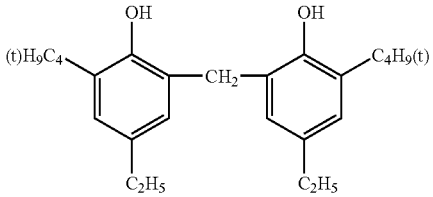

1-7

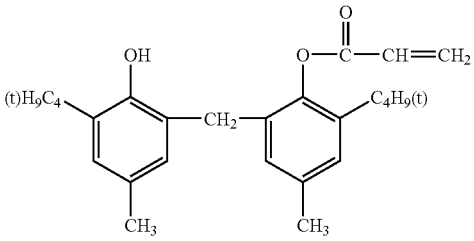

1-8

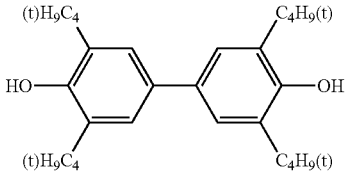

1-9

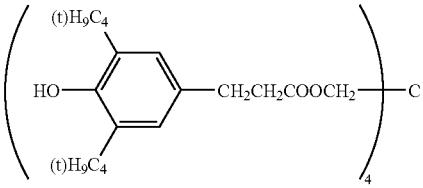

1-10

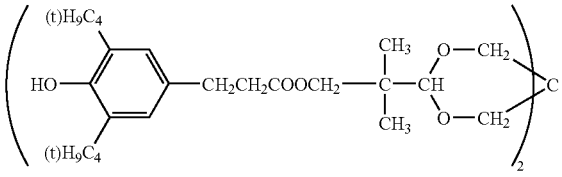

-continued
1-11
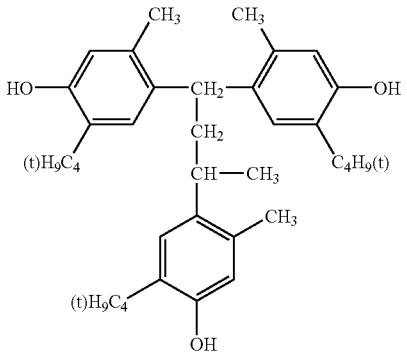
2-1
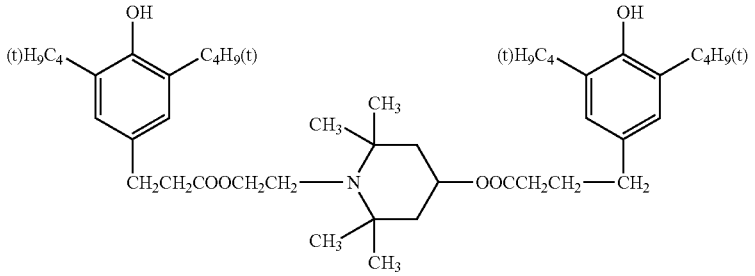
2-2
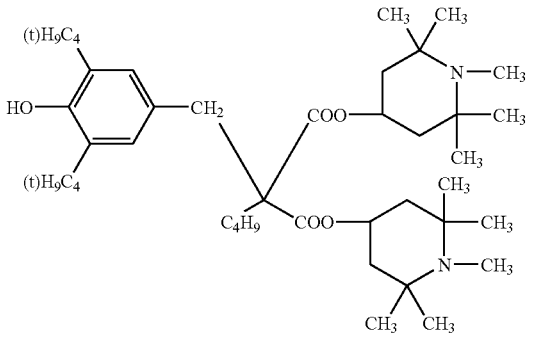
2-3
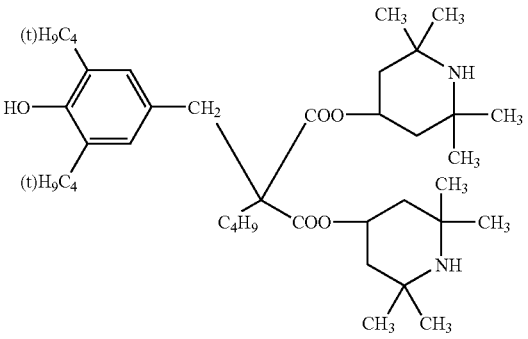
2-5
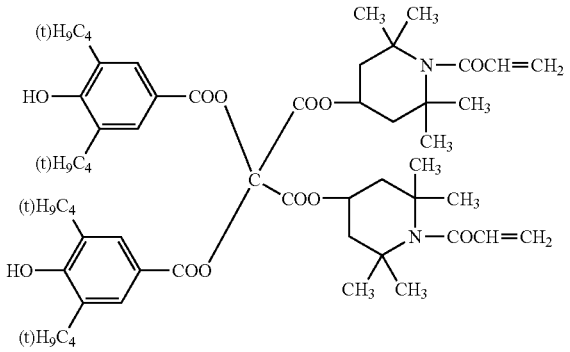
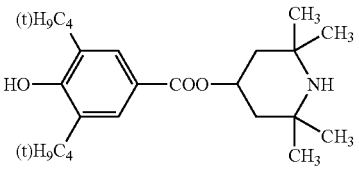
2-6
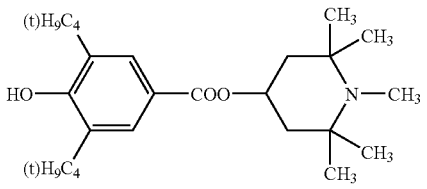

-continued 2-7

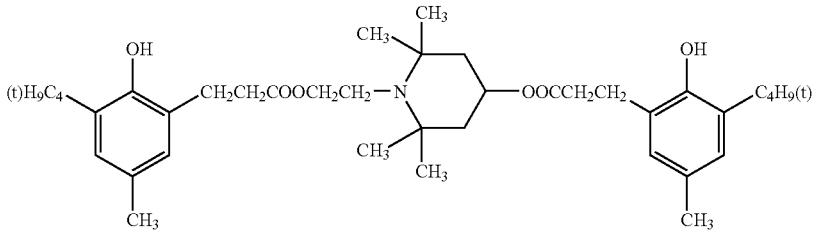

Examples of antioxidant available on the market include the followings.

Hindered phenol type antioxidant: IRGANOX 1076, IRGANOX 1010, IRGANOX 1098, IRGANOX 245, IRGANOX 1330, IRGANOX 3114, IRGANOX 1076, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

The following describes the configuration of the organic photoreceptor other than the surface layer:

The organic photoreceptor refers to an electrophotographic photoreceptor equipped with at least one of an electric charge generating function essential to the configuration of the electrophotographic photoreceptor, and an electric charge transport function. It includes all the photoreceptors composed of the commonly known organic charge generating substances or organic charge transfer substances, and the known organic photoreceptors such as the photoreceptor wherein the charge generating function and charge transfer function are provided by the high-molecular complex.

There is no restriction to the layer arrangement of the photoreceptor. It includes the following configurations:

1) A configuration wherein the photosensitive layer includes an electric charge generating layer and electric charge transport layer laid sequentially one on top of the other on a conductive support.

2) A configuration wherein the photosensitive layer includes an electric charge generating layer and the first and second electric charge transport layers laid sequentially one on top of another on a conductive support.

3) A configuration wherein the photosensitive layer includes a single layer containing an electric charge transport material and an electric charge generating material laid on a conductive support.

4) A configuration wherein the photosensitive layer includes an electric charge transport layer and electric charge generating layer laid sequentially one on top of the other on a conductive support.

5) A configuration of the photoreceptor described in the aforementioned 1) through 4) wherein a surface protective layer is further provided.

The photoreceptor can be made in any one of the aforementioned configurations. The surface layer of the photoreceptor is the layer in contact with the air boundary. When a single layer photosensitive layer alone is formed on the conductive support, this photosensitive layer corresponds to the surface layer. When a single layer or a laminated photosensitive layer and surface protective layer are laid on the conductive support, the surface protective layer serves as an extreme surface layer. In the photoreceptor, the configuration (2) is most preferably used. In the photoreceptor, the substrate layer may be formed on the conductive support, prior to the formation of the photosensitive layer, independently of the type of configuration adopted.

The electric charge transport layer can be defined as a layer having a function of transporting the electric charge carrier generated on the electric charge generating layer due to light exposure, to the surface of the organic photoreceptor. Specific detection of the electric charge transport function can be confirmed by laying the electric charge generating layer and electric charge transport layer on the conductive support, and by detecting the photoconductivity.

The following describes a specific configuration of the photosensitive layer, with reference to an example of the layer configuration (2) that is most preferable:

Conductive Support:

A sheet-like or cylindrical conductive support may be used as the conductive support for the photoreceptor.

The cylindrical conductive support can be defined as a cylindrical support required to form images on an endless basis through rotation. The preferred straightness is 0.1 mm or less and run-out is 0.1 mm or less, for good image forming.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature. Particularly preferable substrate is aluminum, which may contain manganese, zinc, and magnesium in addition to primary component aluminum.

Intermediate Layer:

An intermediate layer equipped with barrier function can be provided between the conductive support and photosensitive layer.

The preferable intermediate layer contains N-type semiconductive fine particles. The N-type semiconductive fine particles refer to the ones that convert conductive carriers into electrons. Converting conductive carriers into electrons refers to the property of effectively blocking the hole injection from the substrate by containing the N-type semiconductive fine particles in the insulating binder, without blocking the electron from the photosensitive layer.

The following describes the method of identifying the N-type semiconductive particles.

An intermediate layer having a film thickness of 5 μm (intermediate layer formed by using a dispersion having 50 wt % of particles dispersed in the binder resin constituting the intermediate layer) is formed on the conductive support. This intermediate layer is negatively charged and the light damping property is evaluated. Further, it is positively charged, and the light damping property is evaluated in the same manner.

The N-type semiconductive particles are defined as the particles dispersed in the intermediate layer in cases where the light damping property, when negatively charged in the evaluation, is greater than that when positively charged.

The N-type semiconductive particles include the particles of titanium oxide ($TiO_2$), zinc oxide (ZnO) and tin oxide ($SnO_2$), and the titanium oxide is preferable.

The number average primary particle diameter is preferably 3.0 nm to 200 nm, more preferably 5 to 100 nm. The number average primary order particle size of the N type semi-conductive fine particles described above is obtained by the following. For example, the titanium oxide particles are magnified by a factor of 10,000 according to a transmission electron microscope, and one hundred particles are randomly selected as primary order particles from the magnified particles, and are obtained by measuring an average value of the FERE diameter according to image analysis. The intermediate layer using the N-type semiconductive particles where the number average primary particle diameter is within the aforementioned range permits dispersion in the layer to be made more compact, and is provided with sufficient potential stability and black spot preventive function.

The N-type semiconductive particles are configured in a branched, needle-shaped or granular form. These N-type semiconductive particles—for example, in the case of titanium oxide—are available in various crystal types such as anatase, rutile and amorphous type. Of these types, the rutile type titanium oxide pigment is particularly preferred since it enhances rectifying characteristics of charge through the intermediate layer, i.e., mobility of electron, whereby charge potential is stabilized and generation of transfer memory is prohibited as well as increase of residual potential is prohibited.

A hydrogenpolysiloxane compound is preferably used as the reactive organic silicon compound to be used in the last surface treatment of the N-type semiconductive particles. The hydrogenpolysiloxane having a molecular weight of from 1,000 to 20,000 is easily available and shows a suitable black spot inhibiting ability, and gives good half tone image The polymer containing a methylhydrogensilixane unit is preferably a copolymer of a structural unit of —($HSi(CH_3)O$)— and another siloxane unit. Preferable another siloxane unit is a dimethylsioxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a lock copolymer and a graft copolymer are usable. The copolymerizing composition other than the methylhydrogensiloxane may be one or more kinds.

The N-type semiconductor particle may be one subjected to surface treatment by a reactive organic compound represented by the following formula.

$$(R)_n—Si—(X)_{4-n}$$

In the above, Si is a silicon atom, R is an organic group directly bonded by the carbon atom thereof to the silicone atom, X is a hydrolyzable group and n is an integer of 0 to 3.

In the organic silicone compound represented by the above formula, the organic group represented by R which is directly bonded by the carbon atom thereof to the silicone atom is, for example, an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl)ethyl group; a (metha)acryloyl group-containing group such as a γ-acryloxypropyl group and a γ-methacryloxypropyl group; a hydroxyl group-containing group such as a γ-hydroxypropyl group and a 2,3-dihydroxypropyloxypropyl group, a vinyl group-containing group such as a vinyl group and a propenyl group; a mercapto group-containing group such as a γ-mercaptopropyl-group: an amino group-containing such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluoroctylethyl group; and a nitro group and a cyano-substituted alkyl group. Examples of the hydrolyzable group include an alkoxy group such as a methoxy group and an ethoxy group; a halogen atom and an acyloxy group.

The organic silicone compound represented by the foregoing may be employed singly or in combination of two or more kinds thereof.

In the compounds represented by the foregoing organic silicone compound, plural groups represented by R may be the same or different when n is 2 or more.

The N-type semiconductor particle may be subjected to a surface treatment by alumina or silica before the surface treatment by the nethylhydrogensiloxane copolymer or the reactive organic silicone compound.

The treatment by alumina and that by silica may be performed simultaneously, and it is particularly preferable that the treatment by alumina is firstly carried out and then the treatment by silica is provided. The amount of silica is preferably larger than that of alumina when the treatments by alumina and silica are applied.

The surface treatment of the N-type semiconductor fine particle such as titanium oxide by alumina, silica or zirconia can be performed by a wet method. For example, the surface-treated N-type semiconductor particle can be prepared as follows.

When titanium oxide particle is employed as the N-type semiconductor particle, aqueous slurry is prepared by dispersing titanium oxide particles having a number average primary particle diameter of 50 nm in a concentration of from 50 to 350 g/L, and a water-soluble silicate or a water-soluble aluminum compound is added to the slurry. After that, the slurry is neutralized by adding an alkali or an acid so as to precipitate silica or alumina onto the surface of the titanium oxide particles. And then the particles are filtered, washed and dried for obtaining the objective surface-treated titanium oxide. When sodium silicate is employed as the water-soluble silicate, the neutralization can be carried out by an acid such as sulfuric acid, nitric acid hydrochloric acid. When aluminum sulfate is employed as the water-soluble aluminum compound, the neutralization can be performed by an alkali such as sodium hydroxide and potassium hydroxide.

An intermediate layer coating liquid prepared for forming the intermediate layer employed in the invention is constituted by a binder and a dispersing solvent additional to the surface-treated N-type semiconductor particles.

The ratio of the N-type semiconductor particles to the binder resin in the intermediate layer is preferably from 1.0 to 2.0 times of the binder resin in the volume ratio. By employing the N-type semiconductor particles in such the high density in the intermediate layer, a rectifying ability of the intermediate layer is increased so that the increasing of the remaining potential and the transfer memory are not caused even when the thickness of the layer is increased, the black spots can be effectively prevented and the suitable organic photoreceptor with small potential fluctuation can be prepared. In the intermediate layer, 100 to 200 parts by volume of the N-type semiconductor particles are preferably employed to 100 parts by volume the binder resin.

As the binder for dispersing the particles and forming the interlayer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the interlayer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4%.

The heat of fusion of the resin is measured by differential scanning calorimetry (DSC). Another method may be utilized as long as a result the same as that obtained by DSC can be obtained. The heat of fusion is obtained from the area of endothermic peak in the course of temperature rising in the DSC measurement.

The water absorption degree of the resin is measured by the weight variation by a water immersion method or Karl-Fischer's method.

As the binder resin of the interlayer, a resin superior in the solubility in solvent is necessary for forming the interlayer having a uniform layer thickness. Alcohol-soluble polyamide resins are preferable for the binder resin of the interlayer. As such the alcohol-soluble polyamide resin, copolymerized polyamide resins having a short carbon chain between the amide bond such as 6-Nylon and methoxymethylized polyamide resins have been known. These resins have high water absorption degree, and the interlayer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g. and a water absorption degree of not more than 5% by weight are employed to improve such the shortcoming of the usual alcohol-soluble polyamide resin. Thus good electrophotographic image can be obtained even when the exterior environmental conditions are changed and the electrophotographic photoreceptor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole-% of the entire repeating units.

The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 5, in which the number of carbon atoms included in X is the carbon number of the amide bond unit in the repeating unit. The repeating unit structure of Type B is represented by Formula 6, in which both of the number of carbon atoms included in Y and that included in Z are each the number of carbon atoms of the amide bond in the repeating unit structure.

Formula 5

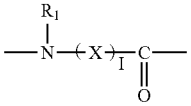

In the above, $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 6

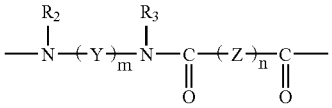

$R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30 for inhibiting the hygroscopic property of the polyamide resin so that the photographic properties, particularly the humidity dependency of the potential on the occasion of the repeating use is made small and the occurrence of the image defects such as the black spots is inhibited without lowering of the solubility of the resin in the solvent for coating. The carbon number is preferably from 9 to 25, more preferably from 11 to 20. The ratio of the structural repeating unit having from 7 to 30 between the amide bonds to the entire repeating units is from 40 to 100 mole-percent, preferably from 60 to 100 mole-percent, and further preferably from 80 to 100 mole-percent.

Number of carbon atoms of polyamide is preferably 7-30, since such polyamide has adequate hygroscopicity and good solubility in solvent for coating composition.

Polyamide resins having a repeating unit structure represented by Formula 7 are preferred.

Formula 7

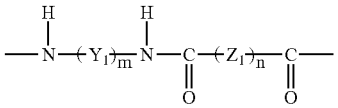

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable; since such the polyamide resins display considerable improving effect on the black spot occurrence.

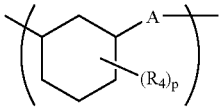

In the above, A is a simple bond or an alkylene group having from 1 to 4 carbon atoms; $R_4$ is an alkyl group; and p is a natural number of from 1 to 5. Plural $R_4$ may be the same as or different from each other.

Concrete examples of the polyamide resin are shown below.

N-1

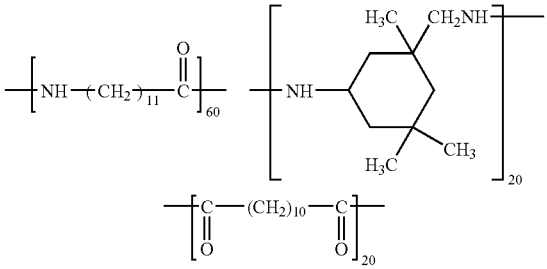

(100%)

N-2

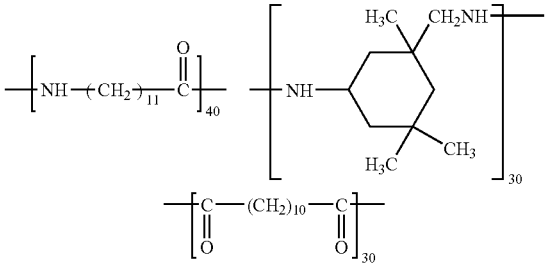

(100%)

-continued

N-3

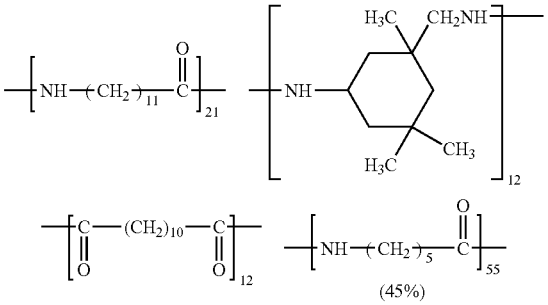

(45%)

N-4

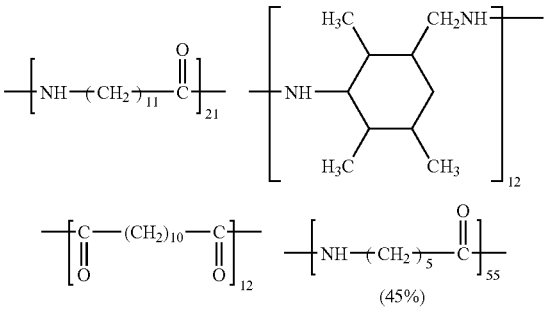

(45%)

N-5

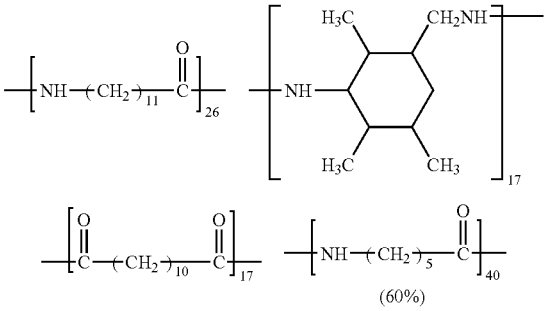

(60%)

N-6

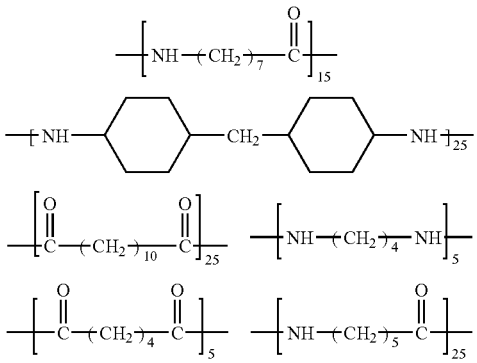

(65%)

N-7

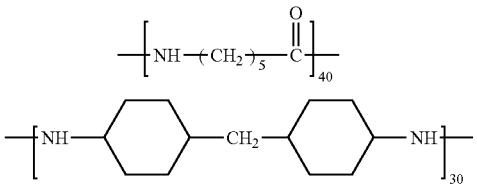

-continued

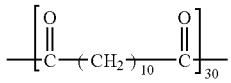

(60%)

N-8

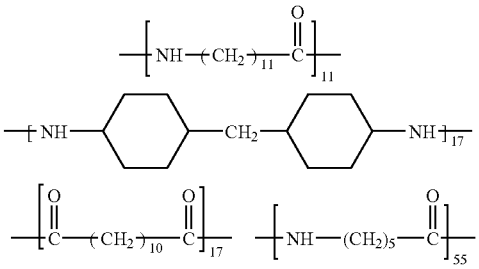

(45%)

N-9

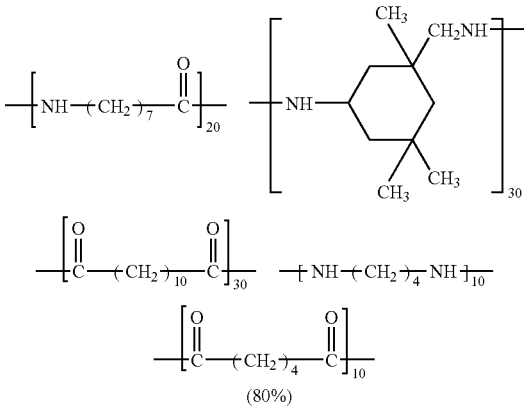

(80%)

N-10

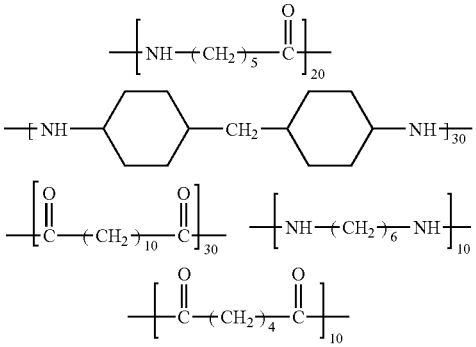

(60%)

N-11

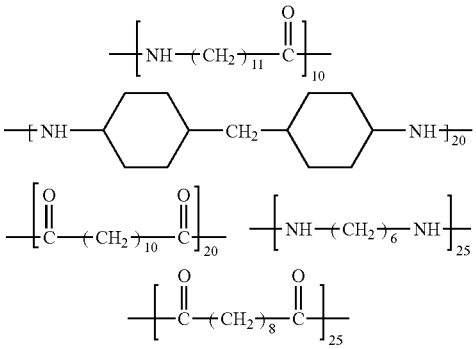

(75%)

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 7 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

The polyamide resin, for example, VESTAMELT X1010 and X4685, manufactured by Daicel•Degussa Ltd., are available in the market, and it is easy to prepare in a usual method. An example of the synthesis method is described.

Synthesis of Exemplified Polyamide Resin N-1

In a polymerization kettle, to which a stirrer, nitrogen, a nitrogen gas introducing pipe, a thermometer and a dehydration tube were attached, 215 parts by weight of laurillactam, 112 parts by weight of 3-aminomethyl-3,5,5-trimethylcyclohexylamine, 153 parts by weight of 1,12-dodecane dicarboxylic acid and 2 parts by weight of water were mixed and reacted for 9 hours while applying heat and pressure and removing water by distillation. The resultant polymer was taken out and the composition of the copolymer was determined by $C^{13}$-NMR, the composition of the polymer agreed with that of N-11. The melt flow index (MFI) of the above-synthesized copolymer was 5 g/10 min under the condition of 230° C./2.16 kg.

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

Thickness of the interlayer is preferably 0.3-10 μm, and more preferably 0.5-5 μm, in view of minimized generation of black spots and non-uniform image at half tone area, inhibiting increase of residual potential and generation of transfer memory, whereby good image having high sharpness can be obtained.

The interlayer is substantially an insulation layer. The volume resistivity of the insulation layer is not less than $1\times10^{8}$ Ω·cm. The volume resistivity of the interlayer and the protective layer is preferably from $1\times10^{8}$ to $1\times10^{15}$ Ω·cm, more preferably from $1\times10^{9}$ to $1\times10^{14}$ Ω·cm, and further preferably from $2\times10^{9}$ to $1\times10^{13}$ Ω·cm. The volume resistivity can be measured as follows.

Measuring condition: According to JIS C2318-1975

Measuring apparatus: Hiresta IP manufactured by Mitsubishi Chemical Corporation.

Measuring condition: Measuring prove HRS

Applied voltage: 500 V

Measuring environment: 30±2° C., 80±5% RH

Photosensitive Layer

The photosensitive layer preferably has a structure in which the functions of the photosensitive layer are separated into a charge generation layer (CGL) and a charge transfer layer (CTL) provided on the intermediate layer, even though the photosensitive layer constituted by a single layer structure having both of the charge generation function and the charge transfer function may be applied. By the function separated structure, the increasing of the remaining potential accompanied with repeating use can be inhibited and the other electrophotographic properties can be easily controlled for fitting to the purpose. In the negatively charging photoreceptor, the structure in which the charge generation layer (CGL) is provided on the intermediate layer, and the charge transfer layer (CTL) is further provided on the charge generation layer.

The composition of the photosensitive layer of the negatively charging function separated photoreceptor is described below.

Charge Generation Layer

The charge generation layer contains a charge generation material (CGM). Other than that, a binder resin and another additive may be contained.

Gallium-phthalocyanine pigment is preferably employed in the charge generation layer. Though the gallium phthalocyanine pigment displays high sensitivity when it is employed in the organic photoreceptor, the transfer memory tends to occur. In the invention, such the problem relating to the high sensitive gallium phthalocyanine can be solved by a combination of the charge transfer layer. Namely, the barrier for charge moving through the interface of the charge generation layer and the charge transfer layer is probably lowered and the potential accumulation of the transfer charge is further decreased when the charge generation layer using the gallium phthalocyanine pigment and the charge transfer layer containing a charge transfer material represented by Formula 2 or 3 is laminated.

For the gallium-phthalocyanine pigment, chlorogallium-phthalocyanine pigment at least displaying characteristic diffraction peaks at 7.4°, 16.6°, 25.5° and 28.3°, hydroxygallium-phthalocyanine pigment at least displaying characteristic diffraction peaks at 7.5°, 9.9°, 12.5°, 16.3°, 18.6°, 25.1° and 28.1°, and gallium-phthalocyanine pigment at least displaying characteristic diffraction peaks at 6.8°, 12.8°, 15.8° and 26.6° in Bragg angle ($2\theta \pm 0.2°$) in the Cu—K$\alpha$ characteristic X-ray diffraction spectrum are preferable. By combining the charge generation layer containing gallium-phthalocyanine pigment displaying such the X-ray diffraction spectrum with the charge transfer layer, a photoreceptor having high sensitivity can be obtained by which a suitable electrophotographic image can be formed which is improved in the occurrence of the unevenness and the burring of image caused by the dash marks and the scratches and in the transfer memory.

Although the above-mentioned titanyl phthalocyanine-added pigment can be used for an organic photoreceptor as electric charge occurrence substance, in addition, phthalocyanine pigments, an azo pigment, a perylene pigment, an azulenium pigment, etc. can be used together.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.3 to 2 mm.

Charge Transporting Layer

As described above, the structure which constitutes the charge transporting layer from plural charge transporting layers and make a charge transporting layer of the top layer contain fluorine based resin particles is preferable.

A charge transporting layer contains a charge transporting material (CTM) and a binder resin for dispersing the CTM and forming a layer. In addition to the fluorine based resin particles, the charge transporting layer may contain additives such as an antioxidant agent if necessary.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly-N-vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by weight to 100 parts of charge transporting material by weight.

Moreover, it is preferable to make the surface layer containing the fluorine-containing resin fine particles contain an antioxidant. Although the surface layer containing a fluorine-containing resin fine particles tends to oxidize with activated gas at the time of charging of a photoreceptor, for example, NOx, ozone, etc., and easily generates a blur image, the occurrence of a blur image can be prevented by making an antioxidant exist together with it. Here, as an added amount of the antioxidant, 0.1 parts to 50 parts is to 100 parts of binders in the surface phase, preferably 0.5 parts to 25 parts. The antioxidant is a material, as a typical one, having a character to prevent or control an action of oxygen under conditions, such as light, heat, and electric discharge, to an auto-oxidizing substance which exists in an organic photoreceptor or on the surface of an organic photoreceptor. Typically, the following compound groups are listed.

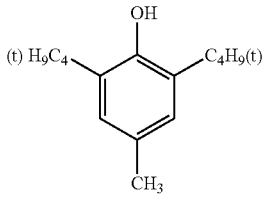
1-1
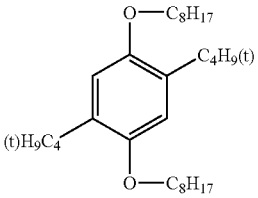
1-2
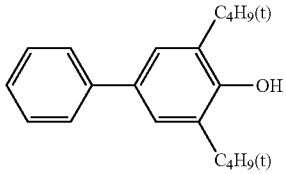
1-3
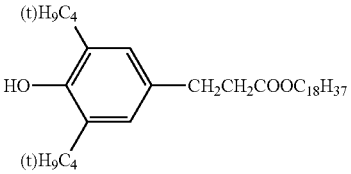
1-4
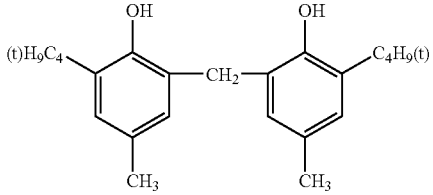
1-5
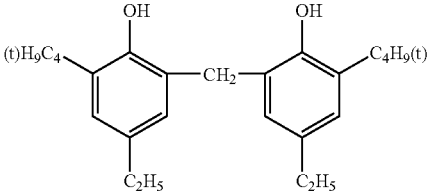
1-6
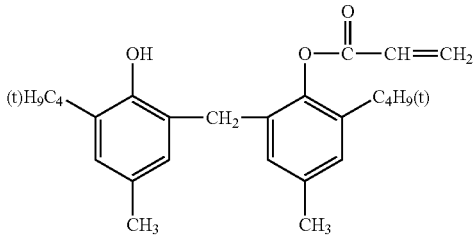
1-7
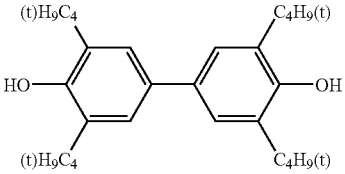
1-8
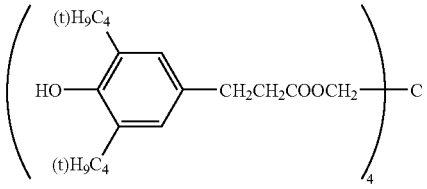
1-9
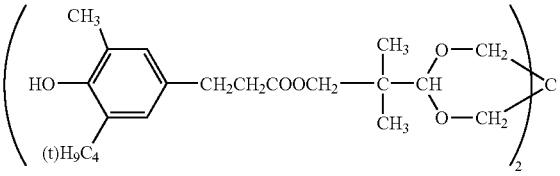
1-10
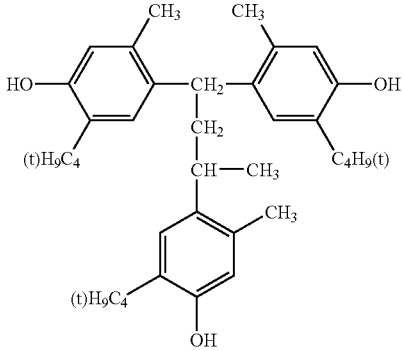
1-11

-continued 2-1

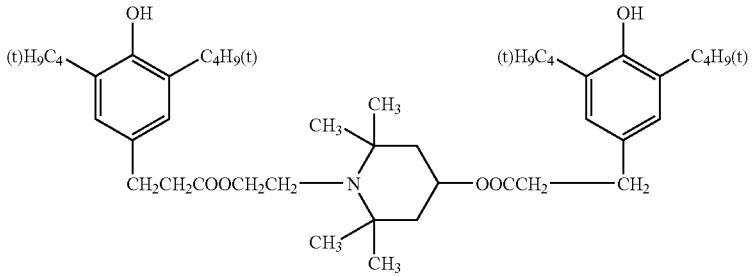

2-2

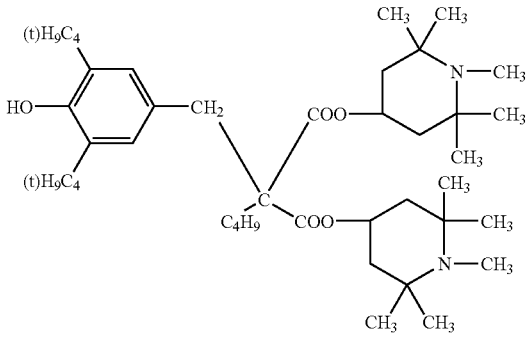

2-3

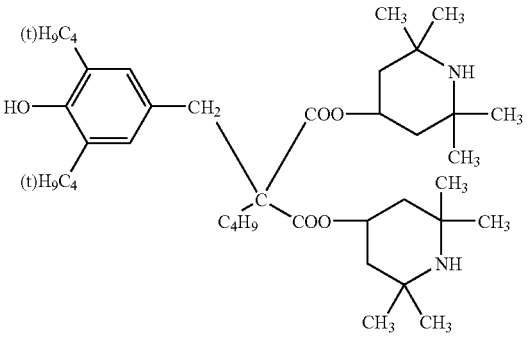

2-4

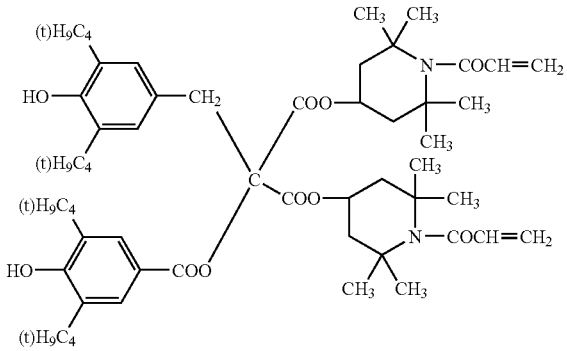

2-5

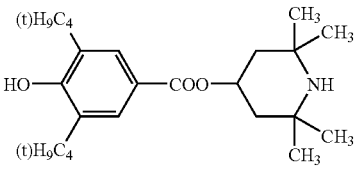

2-6

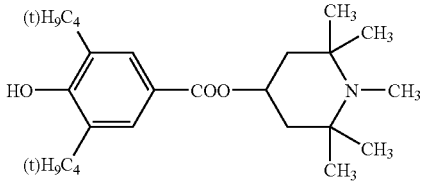

2-7

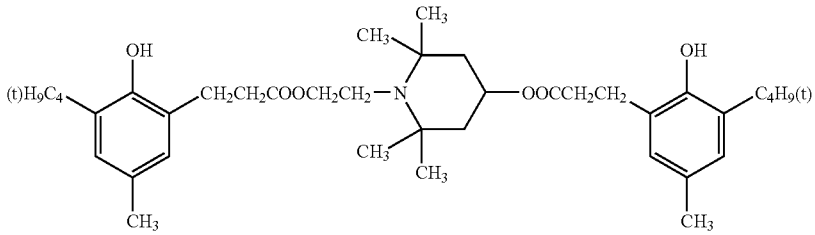

Total thickness of the CTL is preferably 10-40 μm. CTL which is positioned at the surface layer is preferably 0.5-10 μm.

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

The coating liquids for each of the layers are each preferably filtered through a metal filter of a membrane filter before the coating process for removing the foreign matters and coagula in the coating liquids. For example, it is preferable that a pleats type filter HDC, a depth type filter Profile or a semidepth type filter Profilester, each manufactured by Pall Corporation, is selected according to the properties of the coating liquid and employed for filtration.

Figure 3:
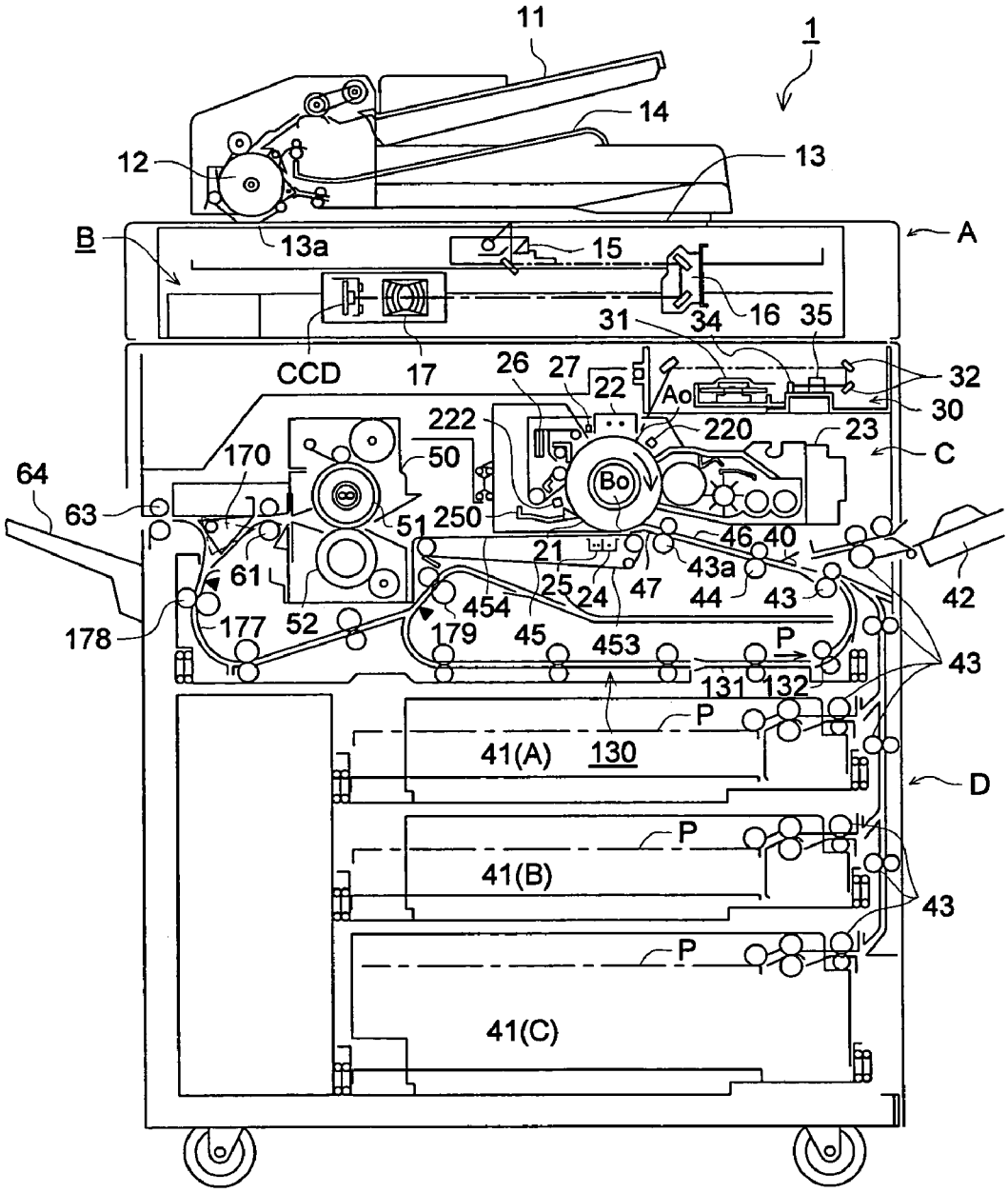
FIG. 3 is a schematic view wherein the functions of the image forming apparatus of the present invention are incorporated.

The following describes the image forming apparatus using an organic photoreceptor:

The image forming apparatus 1 shown in FIG. 3 is a digital image forming apparatus. It comprises an image reading section A, an image processing section B, an image forming section C, and a transfer paper conveyance section D as a transfer paper conveyance means.

An automatic document feed means for automatically feeding documents is arranged on the top of the image reading section A. The documents placed on the document platen as conveyed sheet by sheet by means of a document conveying roller 12, and the image is read at the reading position 13*a*. The document having been read is ejected onto a document ejection tray 14 by the document conveying roller 12.

In the meantime, the image of the document placed on the plate glass 13 is read by the reading operation at the speed v by the first mirror unit 15 consisting of an illumination lamp constituting a scanning optical system and a first mirror, and by the movement of the second mirror unit 16 consisting of the second and third mirrors located at the V-shaped position at the speed v/2 in the same direction.

The scanned images are formed on the light receiving surface of an image-capturing device (CCD) as a line sensor through the projection lens 17. The linear optical images formed on the image-capturing device (CCD) are sequentially subjected to photoelectric conversion into electric signals (luminance signals). Then they are subjected to analog-to-digital conversion, and then to such processing as density conversion and filtering in the image processing section B. After that, image data is stored in the memory.

The image forming section C as an image forming unit comprises:

a drum-formed photoreceptor 21 as an image carrier;

a charging device (charging process) 22 for charging the photoreceptor 21 on the outer periphery;

a potential detecting section 220 for detecting the potential on the surface of the charged photoreceptor;

a developing section (developing process) 23;

a transfer/conveyance belt apparatus 45 as a transfer section (transfer process);

a cleaning apparatus (cleaning process) 26 for the photoreceptor 21; and a PCL (pre-charge lamp) 27 as an optical electric charge eliminator (residual potential eliminating process).

These components are arranged in the order of operations. Further, a reflected density detecting section 222 for measuring the reflected density of the patch image developed on the photoreceptor 21 is provided downstream from the developing section 23. An organic photoreceptor of the present invention is used as the photoreceptor 21, and is driven in the clockwise direction as illustrated.

The rotating photoreceptor 21 is electrically charged uniformly by the charging device 22. After that, image exposure is performed based on the image signal called up from the memory of the image processing section B by the exposure optical system as an image exposure section (image exposure process) 30. In the exposure optical system as an image exposure section 30—a writing section—, the optical path is bent by a reflection mirror 32 through a rotating polygon mirror 31, fθ lens 34, and cylindrical lens 35, using the laser diode (not illustrated) as a light emitting source, whereby main scanning is performed. Exposure is carried out at position Ao with reference to the photoreceptor 21, and an electrostatic latent image is formed by the rotation (sub-scanning) of the photoreceptor 21.

In the image formation method, when an electrostatic latent image is formed on the photoreceptor, image exposure is preferably carried out using the exposure beam having a spot area of $2\times10^{-9}$ $m^2$. Even in the case of such a small-diameter beam exposure, the organic photoreceptor of the present invention is capable of faithfully forming the image corresponding to this spot area. The more preferable spot area is $0.01\times10^{-9}$ through $1\times10^{-9}$ $m^2$, with the result that excellent image quality characterized by at least 400 dpi (dpi: number of dots per 2.54 cm) and 256 gradations is achieved.

The aforementioned spot area of the exposure beam is represented in terms of the area where the intensity of this beam corresponds to the light intensity of $1/e^2$ of the peak intensity.

The exposure beam to be used includes the beams of the scanning optical system using the semiconductor laser and solid scanner such as an LED and liquid crystal shutter. The distribution of the light intensity includes gauss distribution and Lorenz distribution. The portion corresponding to up to $1/e^2$ of each peak intensity is assumed as a spot area.

The electrostatic latent image on the photoreceptor 21 is subject to reverse development by the developing section 23, and a visible toner image is formed on the surface of the photoreceptor 21. According to the image forming method of the present invention, polymerized toner is utilized as the developer for this developing section. An electrophotographic image of better sharpness can be achieved when the polymerized toner having a uniform shape and particle size is used in combination with this organic photoreceptor.

Polymerized toner in the sense is used here refers to toner obtained such that the production of binder resin for toner and the shape of the toner is formed by the polymerization of the material monomer of the binder resin and subsequent chemical treatment. To put it more specifically, polymerized toner refers to the toner gained by suspension polymerization, emulsion polymerization and subsequent fusion process among particles if required.

The polymerized toner is prepared by polymerization subsequent to uniform dispersion of material monomer in a water-based material. This arrangement provides the toner having a uniform particle size distribution and shape.

Polymerized toner can be manufactured by the suspension polymerization method and the method of manufacturing a trace quantity of polymerized particles are manufactured through emulsion polymerization of the monomer in the solution with emulsified liquid of the required additive added thereto, wherein association is performed thereafter by addition of organic solvent and coagulant. There are a method of preparing the polymerized toner by association through mixture with dispersion such as releasing agent and coloring agent required for the formation of toner, and a method of emulsion polymerization subsequent to dispersing toner components such as releasing agent and coloring agent in the monomer.

To be more specific, a coloring agent and, if required, releasing agent and electric charge inhibitor as well as polymerization initiator are added in the polymerized monomer. Various component materials are dissolved or dispersed into the polymerized monomer using a homogenizer, sand mill, sand grinder an ultrasonic pulverizer. The polymerized monomer with these component materials dissolved or dispersed therein is dispersed into oil drops having a desired size as toner in the water-based solvent containing the dispersion stabilizer, using the homomixer and homogenizer. After that, the polymerized monomer is moved into the reactor whose agitation mechanism is made of the agitation blade (to be described later) and is heated therein, thereby promoting polymerization. After reaction, the dispersion stabilizer is removed and the polymerized monomer is filtered, cleaned and dried, whereby toner is prepared.

The toner can also be prepared by association or fusion of resin particles in a water-based medium. Examples of this method are found in the Japanese Patent O. P. I. 5-265252, Japanese Patent O. P. I. 6-329947 and Japanese Patent O. P. I. 9-15904, without being restricted thereto. To be more specific, a plurality of resin particles and dispersed particles of the component materials such as a coloring agent, or resins and fine particles consisting of coloring agents are associated. Especially, after dispersing them in water using an emulsifier, a coagulant having a coagulation concentration in excess of the critical level is added thereto, and the process of salting-out is performed. At the same time, these substances are subjected to heating and fusing above the glass transition point temperature of the formed polymer per se, so that the particle size is gradually increased by growth while fused particles are formed. When the intended particle size has been reached, much water is added to suspend the increase of the particle size. Further heating and agitation are continued until the particle surface becomes smooth, and the shape is controlled. These particles in the state of containing water are heated and dried in the fluid condition, whereby toner is formed. In this case, it is possible to add an organic solvent as well as coagulant to water, wherein the organic solvent is subjected to infinite dissolution.

Japanese Patent Tokkai 2000-214629 describes the details of the material, manufacturing method and polymerized toner reactor required to prepare the toner having a uniform factors such as a geometry.

The content of toner particles having a particle diameter below 0.7×(Dp50) is preferably 10 number %. The ratio (Dv50/Dp50) of toner particles of 50% volume particle diameter (Dv50) and 50% number particle diameter (Dp50) are preferably 1.0-1.15. The ratio (Dv75/Dp75) of a cumulative 75% volume particle. diameter (Dv75) from the largest particle diameter on the volume basis and a cumulative 75% number particle diameter (Dp75) from the largest particle diameter on the number basis is preferably 1.0-1.20.

The 50 percent volume particle diameter (Dv50) is preferably from 3.0 to 9.5 μm, more preferably 3.0 to 7.5 μm. By adjusting said diameter to the above range, it is possible to obtain an enhanced resolution.

The cumulative 75 percent volume particle diameter (Dv75) or the cumulative 75 number particle diameter from the largest particle, as described herein, refers to the volume particle diameter or the number particle diameter at the position of the particle size distribution which shows 75 percent of the cumulative frequency with respect to the sum of the volume or the sum of the number from the largest particle.

It is possible to determine 50 percent volume particle diameter (Dv50), 50 percent number particle diameter (Dp50), cumulative 75 percent volume particle diameter (Dv75), and cumulative 75 percent number particle diameter (Dp75), employing a Coulter Counter Type TAII or a Coulter Multisizer (both are manufactured by Coulter Inc.).

The proportion of colored particles having a diameter of less than or equal to 0.7×(Dp50) is 10 percent by number. It is possible to determine the amount of said minute particle toner, employing an Electrophoretic Light Scattering Spectrophotometer ELS-800, manufactured by Otsuka Electronics Co., Ltd.

In the technical field in which electrostatic latent images are visualized employing dry system development, as an electrostatic image developing toner employed are those which are prepared by adding external additives to colored particles containing at least colorants and resins. However, as long as specifically there occur no problems, it is generally described that colored particles are not differentiated from the electrostatic latent image developing toner. The particle diameter and particle size distribution of the colored particles result in the same measurement values as the electrostatic latent image developing toner.

The particle diameter of external agents is in an order of nm in terms of the number average primary particle. It is possible to determine the diameter employing an Electrophoretic Light Scattering Spectrophotometer "ELS-800" (manufactured by Otsuka Electronics Co., Ltd.).

The structure as well as the production method of the toner will now be described.

<Toner>

Toner which may be prepared by pulverization method or polymerization method can be employed. Polymerization toner is preferably employed because toner having uniform particle size distribution is stably obtained.

The polymerization toner is prepared by polymerization of binder resin of toner from monomers, and if necessary, subsequent chemical process. Practically it includes polymerization process such as suspension polymerization and emulsion polymerization, and fusion process of particles conducted thereafter if necessary.

It is preferable that a coalesced type toner is employed, which is prepared by salting out and fusing resin particles comprising release agents and colorant particles.

As the reason for such toner, it is assumed that since it is possible to easily control the particle size distribution of the coalesced type toner and it is possible to prepare toner particles which exhibit uniform surface properties of each particle, the effects of the present invention are exhibited without degrading transferability.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resin particles and colorant particles) at temperatures higher than or equal to the glass transition temperature (Tg) of resins constituting the resin particles.

Releasing Agent

The preferable releasing agent is exemplified.

$$R^1—(OCO—R^2)_n$$

In the formula n is an integer from 1 to 4, preferably from 2 to 4, and more preferably 3 or 4. $R^1$ and $R^2$ each represents a hydrocarbon group, which may have a substituent.

The number of carbon atoms in $R^1$ is from 1 to 40, preferably from 1 to 20, and more preferably from 2 to 5.

The number of carbon atoms in $R^2$ is from 1 to 40, preferably from 16 to 30, and more preferably from 18 to 26.

In the formula n is an integer from 1 to 4, preferably from 2 to 4, more preferably 3 or 4 and particularly 4.

The compound is synthesized by a dehydration condensation reaction of an alcohol compound and a carbonic acid adequately.

Most preferable example of the compound is pentaerythritoltetrabehanate.

Representative examples are listed as compounds 1 to 22.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

-continued

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

16) $CH_3—(CH_2)_{26}—COO—CH_2—C(CH_3)—CH_2—O—CO—(CH_2)_{26}—CH_3$
$CH_2—O—CO—(CH_2)_{26}-CH_3$

17) $CH_3—(CH_2)_{20}—COO—CH_2—C(CH_2CH_3)—CH_2—O—CO—(CH_2)_{20}—CH_3$
$CH_2—O—CO—(CH_2)_{20}—CH_3$

18) $CH_3—(CH_2)_{26}—COO—CH_2—C(CH_2—O—CO—(CH_2)_{26}—CH_3)—CH_2—O—CO—(CH_2)_{26}—CH_3$
$CH_2—O—CO—(CH_2)_{26}—CH_3$

19) $CH_3—(CH_2)_{20}—COO—CH_2—C(CH_2—O—CO—(CH_2)_{20}—CH_3)—CH_2—O—CO—(CH_2)_{20}—CH_3$
$CH_2—O—CO—(CH_2)_{20}—CH_3$

20) $CH_3—(CH_2)_{18}—COO—CH_2—C(CH_2—O—CO—(CH_2)_{18}—CH_3)—CH_2—O—CO—(CH_2)_{18}—CH_3$
$CH_2—O—CO—(CH_2)_{18}—CH_3$

21) $CH_3—(CH_2)_{16}—COO—CH_2—C(CH_2—O—CO—(CH_2)_{16}—CH_3)—CH_2—O—CO—(CH_2)_{16}—CH_3$
$CH_2—O—CO—(CH_2)_{16}—CH_3$

22) $CH_3—(CH_2)_{20}—COO—CH_2—C(CH_2—O—CO—CH_3)—CH_2—O—CO—CH_3$
$CH_2—O—CO—CH_3$

Content of the Releasing Agent

The content ratio of the releasing agent in the toner is commonly from 1 to 30 percent by weight, is preferably from 2 to 22 percent by weight, and is particularly preferably from 1 to 15 percent by weight.

<Resin Particles Comprising Releasing Agents>

The resin particles containing releasing agents may be obtained as latex particles by dissolving releasing agents in monomers to obtain binding resins, and then dispersing the resulting monomer solution into water based medium, and subsequently polymerizing the resulting dispersion.

Weight average particle size of the latex particles is preferably 50-2000 nm.

Listed as polymerization method employed to obtain resin particles, in which binding resins comprise releasing agents, may be granulation polymerization methods such as an emulsion polymerization method, a suspension polymerization method, a seed polymerization method, and the like.

The following method (hereinafter referred to as an "mini-emulsion method") may be cited as a preferable polymerization method to obtain resin particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which results in oil droplets in water dispersion, utilizing mechanical force, are not particularly limited, and may include "CLEARMIX" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

<Binder Resins>

Binder resins, which constitute the toner of the present invention, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

The composition materials of resin particles and the preparation thereof will now be described.

(Monomers)

Of polymerizable monomers which are employed to prepare resin particles, radical polymerizable monomers are essential components, and if desired, crosslinking agents may be employed. Further, at least one of said radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers. Further, they may be employed in combination of two or more types so as to satisfy desired properties.

Specifically, employed may be aromatic vinyl monomers, acrylic acid ester monomers, methacrylic acid ester monomers, vinyl ester monomers, vinyl ether monomers, monoolefin monomers, diolefin monomers, halogenated olefin monomers, and the like.

Listed as aromatic vinyl monomers, for example, are styrene monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester monomers are vinyl acetate, vinyl propionate, vinyl benzoate, and so on.

Listed as vinyl ether monomers are vinyl methyl ether, vinyl ethyl ether, vinyl isobutyl ether, vinyl phenyl ether, and the like.

Listed as monoolefin monomers are ethylene, propylene, isobutylene, 1-butene, 1-pentene, 4-methyl-1-pentene, and the like.

Listed as diolefin monomers are butadiene, isoprene, chloroprene, and the like.

Listed as halogenated olefin monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomers Having an Acidic Group or a Basic Group

Employed as radical polymerizable monomers having an acidic group or a basic group may, for example, be amine based compounds such as monomers having a carboxyl group, monomers having a sulfonic acid group, and amine based compounds such as primary, secondary, and tertiary amines, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like as monomers having a carboxyl group.

Listed as monomers having sulfonic acid are styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Listed as radical polymerizable monomers having a basic group are amine based compounds which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

The content ratio of radical polymerizable monomers having an acidic group or a basic group is preferably 0.1 to 15 percent by weight with respect to the total monomers. The content ratio of radical polymerizable crosslinking agents is preferably 0.1 to 10 percent by weight with respect to the total radical polymerizable monomers.

(Chain Transfer Agents)

For the purpose of regulating the molecular weight of resin particles, it is possible to employ commonly used chain transfer agents.

Said chain transfer agents are not particularly limited, and for example, employed are mercaptans such as octylmercaptan, dodecylmercaptan, tert-dodecylmercaptan, and the like, carbon tetrabromide, styrene dimer, and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at least room temperature.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyltriphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, nonionic surface active agents may be employed. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

<Colorants>

Listed as colorants which constitute the toner may be inorganic pigments, organic pigments, and dyes.

Employed as said Inorganic pigments may be employed. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

The organic pigments and dyes may be employed. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3,. C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

These organic pigments, as well as dyes, may be employed individually or in combination of selected ones, if desired. Further, the added amount of pigments is commonly between 2 and 20 percent by weight, and is preferably between 3 and 15 percent by weight.

The colorants may also be employed while subjected to surface modification. As said surface modifying agents may be those conventionally known in the art, and specifically, preferably employed may be silane coupling agents, titanium coupling agents, aluminum coupling agents, and the like.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Fine inorganic particles may be employed. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

The toner of the present invention is a coalesced type toner obtained by salting out/fusing resin particles comprising releasing agents and colorant particles in a water based medium. By salting out/fusing said resin particles comprising releasing agents, as described above, a toner is obtained in which said releasing agents are finely depressed.

In addition, the toner of the present invention possesses an uneven surface from the production stage, and a coalesced type toner is obtained by fusing resin particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

<Toner Production Process>

One example of the method for producing the toner of the present invention is as follows:

(1) a dissolution process in which releasing agents are dissolved in monomers and a monomer solution is prepared
(2) a dispersion process in which the resulting monomer solution is dispersed into a water based medium
(3) a polymerization process in which the resulting water based dispersion of said monomer solution undergoes polymerization so that dispersion (latex) of resin particles comprising said releasing agents is prepared
(4) a salting-out/fusion process in which the resulting resin particles and said colorant particles are subjected to salting-out/fusion in a water based medium so as to obtain coalesced particles (toner particles)
(5) a filtration and washing process in which the resulting coalesced particles are collected from the water based medium employing filtration, and surface active agents and the like are removed from said coalesced particles
(6) a drying process in which washed coalesced particles are dried, and
(7) an external addition process may be included in which external agents are added to the dried coalesced particles.

(Dissolution Process)

Methods for dissolving releasing agents in monomers are not particularly limited.

The dissolved amount of said releasing agents in said monomers is determined as follows: the content ratio of releasing agents is generally 1 to 30 percent by weight with respect of the finished toner, is preferably 2 to 20 percent by weight, and is more preferably 3 to 15 percent by weight.

Further, oil-soluble polymerization initiators as well as other oil-soluble components may be incorporated into said monomer solution.

(Dispersion Process)

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers. Further, the diameter of dispersed particles is 10 to 1,000 nm, and is preferably 30 to 300 nm.

(Polymerization Process)

In the polymerization process, polymerization methods (granulation polymerization methods such as an emulsion polymerization method, a suspension polymerization method, and a seed polymerization method) may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting-Out/Fusion Process)

In the salting-out/fusion process, a colorant particle dispersion is added to a dispersion containing resin particles obtained by said polymerization process so that said resin particles and said colorant particles are subjected to salting-out/fusion in a water based medium.

Further, in said salting-out/fusion process, resin particles as well as colorant particles may be fused with internal agent particles and the like.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration.

Homogenizers to disperse colorants are not particularly limited, and preferably listed are "CLEARMIX", ultrasonic homogenizers, mechanical homogenizers, Manton-Gaulin and pressure type homogenizers, and medium type homogenizers such as sand grinders, Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

The salting-out/fusion process is accomplished as follows. Salting-out agents, containing alkaline metal salts and/or alkaline earth metal salts and the like, are added to water comprising resin particles as well as colorant particles as the coagulant at a concentration of higher than critical aggregation concentration. Subsequently, the resulting aggregation is heated above the glass transition point of said resin particles so that fusion is carried out while simultaneously conducting salting-out. During this process, organic solvents, which are infinitely soluble in water, may be added.

Herein, listed as alkali metals and alkali-earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting-out/fusion process, it is preferable that hold-over time after the addition of salting-out agents is as short as possible. Namely it is preferable that after the addition of salting-out agents, dispersion containing resin particles and colorant particles is heated as soon as possible and heated to a temperature higher than the glass transition point of said resin particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resin particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion containing resin particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resin particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing)

In said filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing Buchner's funnel and the like, a filtration method which is carried out employing a filter press, and the like.

(Drying Process)

The washed toner particles are dried in this process.

Listed as dryers employed in this process may be spray dryers, vacuum freeze dryers, vacuum dryers, and the like.

Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices may be mechanical pulverization devices such as a jet mill, a Henschel mixer, a coffee mill, a food processor, and the like.

(Addition Process of External Additives)

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

The proportion of number of toner particles having a diameter of at most 0.7×(Dp50) Proportion of is 10 percent or less. It is preferable to control the temperature during the salting-out/fusion narrow for obtaining toner particles satisfying such condition. More in concrete temperature is elevated as fast as possible. The time for elevation is preferably 30 minutes or less, more preferably 10 minutes or less, and the elevation rate is preferably 1 to 15° C./minutes.

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resin particles as well as colorant particles so as to be incorporated into the toner, another is one in which said charge control agents are added to resin particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

In the transfer paper conveyance section D, sheet feed units 41(A), 41(B) and 41(C) as a transfer sheet storage means are arranged below the image forming unit, wherein the transfer sheets P having different sizes are stored. A manual sheet feed unit 42 for manual feed of the sheets of paper is provided on the side. The transfer sheets P selected by either of the two are fed along a sheet conveyance path 40 by a guide roller 43, and are temporarily suspended by the sheet feed registration roller 44 for correcting the inclination and deviation of the transfer sheets P. Then these transfer sheets P are again fed and guided by the sheet conveyance path 40, pre-transfer roller 43*a*, paper feed path 46 and entry guide plate 47. The toner image on the photoreceptor 21 is transferred to the transfer sheet P at the transfer position Bo by a transfer electrode 24 and a separator electrode 25, while being carried by the transfer/conveyance belt 454 of the transfer/conveyance belt apparatus 45. The transfer sheet P is separated from the surface of the photoreceptor 21 and is brought to a fixing apparatus 50 as a fixing means by the transfer/conveyance belt apparatus 45.

The fixing apparatus 50 contains a fixing roller 51 and a pressure roller 52. When the transfer sheet P passes between the fixing roller 51 and pressure roller 52, toner is fixed in position by heat and pressure. With the toner image having been fixed thereon, the transfer sheet P is ejected onto the ejection tray 64.

The above description is concerned with the case where an image is formed on one side of the transfer sheet. In the case of duplex copying, the ejection switching member 170 is switched and the transfer sheet guide 177 is opened. The transfer sheet P is fed in the direction of an arrow showed in a broken line.

Further, the transfer sheet P is fed downward by the conveyance device 178 and is switched back by the sheet reversing section 179. With the trailing edge of the transfer sheet. P becoming the leading edge, the transfer sheet P is conveyed into the sheet feed unit 130 for duplex copying.

The conveyance guide 131 provided on the sheet feed unit 130 for duplex copying is moved in the direction of sheet feed by the transfer sheet P. Then the transfer sheet P is fed again by the sheet feed roller 132 and is led to the sheet conveyance path 40.

As described above, the transfer sheet P is again fed in the direction of the photoreceptor 21, and the toner image is transferred on the reverse side of the transfer sheet P. After the image has been fixed by the fixing section 50, the transfer sheet P is ejected to the ejection tray 64 through a roller pair 63.

The image processing apparatus can be configured in such a way that the components such as the aforementioned photoreceptor, developing device and cleaning device are integrally combined into a process cartridge, and this unit is removably mounted on the apparatus proper. It is also possible to arrange such a configuration that at least one of the charging device, image exposure device, developing device, transfer electrode, separator electrode and cleaning device is supported integrally with the photoreceptor, so as to form a process cartridge that, as a removable single unit, is mounted on the apparatus proper, using a guide means such as a rail of the apparatus proper.

Figure 4:
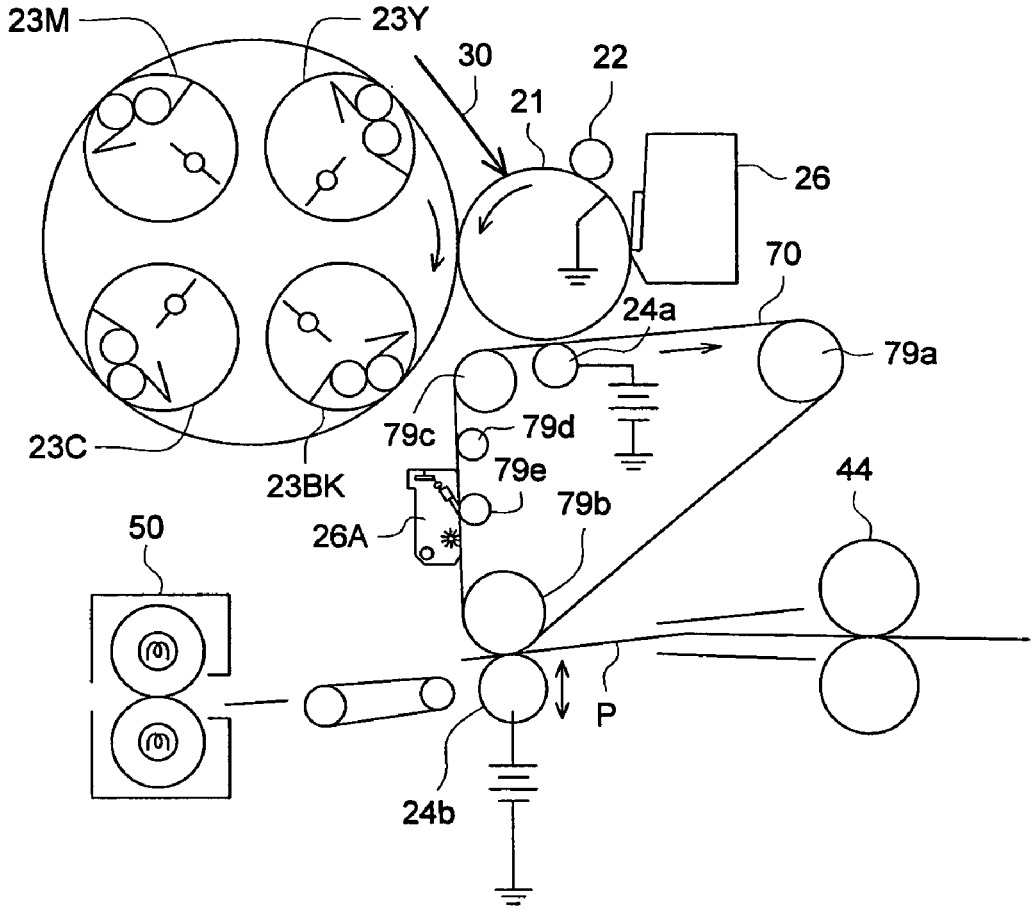
FIG. 4 is a configuration cross sectional view of an example of a color image forming apparatus using the organic photoreceptor of the present invention.

FIG. 4 is a configuration cross sectional view of a color image processing apparatus (a copying machine or laser beam printer equipped with at least a charging device, an exposure section, a plurality of developing sections, a transfer section, a cleaning section and an intermediate transfer member arranged around the organic photoreceptor) using the organic photoreceptor of the present invention. The belt-like intermediate transfer member 10 is made of an elastic body of medium resistance.

Numeral 21 denotes a rotary drum type photoreceptor used repeated as an image forming member, and is driven at a predetermined peripheral speed in the counterclockwise direction marked by an arrow.

While rotating, the rotating photoreceptor 21 is electrically charged by the charging section 22 uniformly to get a predetermined polarity and potential. Then image exposure is carried out by the scanning exposure beam of the laser beam modulated in conformity to the time-series electric digital image signal of image information by an optical exposure section 30 (not illustrated). This procedure forms an electrostatic latent image corresponding to the yellow (Y) color component image as the intended color image.

Then the electrostatic latent image is developed by the first yellow (Y) toner by means of the yellow (Y) developing section 23Y (yellow color developing section). In this case, the second through fourth developing sections 23M, 23C and 23Bk (magenta, cyan and black developing sections) are disabled and does not act on the photoreceptor 21. The aforementioned first yellow toner image is not affected by the second through fourth developing sections.

The intermediate transfer member 70 is tightened by the rollers 79*a*, 79*b*, 79*c*, 79*d* and 79*e*, and is driven in the clockwise direction at the same peripheral speed as the photoreceptor 21.

The first yellow toner image formed on the photoreceptor 21 and carried thereby is transferred sequentially onto the outer peripheral surface of the intermediate transfer member 70 on an intermediate basis, by the electric field created by the primary transfer bias applied to the intermediate transfer member 70 from the primary transfer roller 24*a* in the process of passing through the nip between the image forming apparatus 1 and intermediate transfer member 70.

A cleaning apparatus 26 is used to clean the surface of the photoreceptor 21 on which the first yellow toner image corresponding to the intermediate transfer member 70 has been transferred.

In the same manner, the second magenta toner image, third cyan toner image and fourth black toner image are sequentially superimposed and transferred on the intermediate transfer member 70, whereby a superimposed color toner image corresponding to the intended color image is formed.

Supported by a bearing in parallel corresponding to the secondary transfer opposing roller 79*b*, a secondary transfer roller 24*b* is arranged detachably on the lower surface of the intermediate transfer member 70.

The primary transfer bias for sequential transfer by superimposition from the photoreceptor 21 to the intermediate transfer member 70 is reverse in polarity to that of the toner, and is applied from a bias power source. The applied voltage, for example, ranges from +100 V to +2 kV.

In the primary transfer process of the first through third color toner images from the photoreceptor 21 to the intermediate transfer member 70, the secondary transfer roller 24*b* and intermediate transfer member cleaning section 26A can be separated from the intermediate transfer member 70.

The following describes the process of transfer to the transfer sheet P as a secondary carrier of the toner image transferred by superimposing onto the belt-shaped intermediate transfer member 70. The secondary transfer roller 24*b* is brought in contact with the belt of the intermediate transfer member 70, and the transfer sheet P is fed to the nip section of the belt of the intermediate transfer member 70 in contact with the secondary transfer roller 24*b* from a pair of sheet feed registration rollers 44 through a transfer paper guide at a predetermined timed interval. The secondary transfer bias applied to the secondary transfer roller 24*b* from the bias voltage source. Then the color toner image is by superimposition transferred (secondarily) onto the transfer sheet P as a secondary image carrier from the intermediate transfer member 70 by the secondary transfer bias. The transfer sheet P with the toner image transferred thereon is led into the fixing apparatus 50, where the transfer sheet P is heated and fixed.

The organic photoreceptor in the present invention is applicable to such an electrophotographic apparatus in general as an electrophotographic copying machine, laser printer, LED printer and liquid crystal shutter type printer. Further, it is also applicable over a wide range to a display, recorder, light printer, prepressing machine and facsimile machine that are based on electrophotographic technology.

EXAMPLES

Example 1

The photoreceptor 1 was produced as follows.

The cylinder type aluminum base support, which surface has 10 points surface roughness Rz of 0.81 μm measured according to regulation of JISB-0601 by subjecting to cutting process and washed, was subjected to coating with the following interlayer coating composition by dipping and thereafter drying, an interlayer having dry thickness of 1.0 μm was prepared.

The following intermediate layer dispersion liquid was diluted twice with the same mixed solvent, and filtered after settling for overnight (filter; Nihon Pall Ltd. company make RIGIMESH 5 μm filter), whereby the intermediate layer coating solution was produced.

Binder resin, exemplified Polyamide N-1) 1 part (1.0 part by volume)

Rutile type titanium oxide Al (number average primary particle diameter of 35 nm: subjected to surface treatment by titanium oxide subjected to a copolymer of methyl hydrogen polysiloxane and dimethylsiloxane, molar ratio=1:1, in amount of 5 weight % of the titanium oxide) 3.5 parts (1.0 part by volume)

Ethanol/n-propylalcohol/THF (=45/20/30 by weight) 10 parts

The above-mentioned composites were mixed, dispersion was performed for 10 hours by a batch system, using a sand mill homogenizer, and whereby intermediate layer dispersion liquid was produced.

Electric Charge Generating Layer (CGL)

The following composition was mixed and dispersed by use of a sand mill, resulting in preparation of a charge generating layer coating solution. This solution was coated on the aforesaid intermediate layer by means of an immersion coating method to form a charge generating layer having a dry layer thickness of 0.3 μm.

| | |
|---|---|
| Charge generating substance: titanyl phthalocyanine pigment (hydroxy gallium phthalocyanine pigment having the specific peak of Bragg angle 2θ (±0.2) at least at 7.5°, 9.9°, 12.5°, 16.3°, 18.6°, 25.1° and 28.1° based on a Cu—Kα characteristic X-ray diffraction spectrum measurement) | 20 parts |
| Polyvinyl butyral silicon denaturalized | 10 parts |
| 4-methoxy-4-methyl-2-pentanone | 700 parts |
| t-Butyl acetate | 300 parts |
| Charge Transporting Layer 1 (CTL 1) | |
| Charge transporting substance (CT1-3) | 225 parts |
| Polycarbonate (Z300: manufactured by Mitsubishi Gas Chemical Company, Inc.) | 300 parts |
| Anti-oxidant (Exemplified compound 2-1) | 6 parts |
| Dichloromethane | 2000 parts |
| Silicone oil (KF-54: manufactured by Shin-Etsu Chemical Co., Ltd.) | 1 part |

The above composition was mixed and dissolved to prepare a charge transporting layer coating solution. This solution was coated on the aforesaid charge generating layer by means of an immersion coating method and dried at 110° C. for 70 minutes to form the first charge transporting layer having a dry layer thickness of 18.0 μm.

<Preparation of Polytetrafluoroethylene Resin Particle (PTFE Particle) Dispersion Liquid>

PTFE particles having an average primary particle diameter of 0.12 μm and a crystallinity of 91.3 was thermally treated at 250° C. for 40 minutes for making the crystallinity to 82.8, and a PTFE particle dispersion liquid was prepared using the PTFE particles as follows.

| | |
|---|---|
| PTFE particle PT1 (average primary particle diameter: 0.12 μm, crystallinity: 82.2) | 200 parts |
| Toluene | 600 parts |
| Fluorine-containing comb type graft polymer GF300 (TOAGOSEI Co., Ltd.) | 15 parts |

The above composition was mixed and dispersed by a sand grinder, manufactured by Amex Co., Ltd, to prepare a PTFE particle dispersion liquid.

| <Charge Transfer Layer 2 (CTL 2)> | |
|---|---|
| PTFE particle dispersion liquid (whole amount) | 815 parts |
| Charge transfer material CT1-3 | 150 parts |
| Polyarylate (Po-2, viscosity average molecular weight of 40,000) | 150 parts |
| Siloxane-modified polyarylate (Po-26, viscosity average molecular weight of 20,000) | 150 parts |
| Anti-oxidant (Exemplified Compound 1-1) | 12 parts |
| Monochlorobenzene/dichloromethane (1/1) mixture | 2800 parts |
| Silicone oil KF-54 (Shin-Etsu Chemical Co., Ltd. company) | 4 parts |

The above composition was mixed and dissolved to prepare Charge Transfer Layer Coating Liquid 2. The coating liquid was coated on the foregoing Charge Transfer Layer 1 by the circular slide hopper type coating apparatus and dried at 110° C. for 70 minutes to for Charge Transfer Layer 2 (surface layer) having a dried thickness of 2.0 μm. Thus Photoreceptor 1 was prepared.

Preparation of Photoreceptors 2 through 12

Photoreceptors 2 through 12 were prepared in the same manner as in Photoreceptor 1 except that the N-type semiconductor material, kind of binder resin and thickness of the interlayer, the CGL, amount of polyarylate, siloxane modified polyarylate and fluorinated resin particle in Charge Transfer Layers 1 and 2 were changed as shown in Table 1.

TABLE 1

| | | | | | Fluororesin particle in CTL 2 | | | | | |
|---|---|---|---|---|---|---|---|---|---|---|
| Photoreceptor No. | Interlayer No. | CGM in CTL | CTM in CTL 1 and 2 | Polyarylate | Kind of fluororesin particle | Primary particles (μm) (**) | Crystallinity (%) | Adding amount (parts) | Contact angle (°) | Variation of contact angle (\|°\|) |
| 1 | 1 | G1 | CT1-3 | Po-2 Po-26 | PTFE-1 | 0.12 | 82.2 | 200 | 111 | 1.2 |
| 2 | 2 | G2 | *1 | Po-2 Po-26 | PTFE-2 | 0.03 | 73.4 | 200 | 114 | 0.7 |
| 3 | 3 | G3 | CT1-1 | Po-1 Po-30 | PTFE-3 | 0.19 | 86.2 | 200 | 108 | 1.7 |
| 4 | 1 | G1 | CT1-3 | Po-2 Po-26 | PTFE-4 | 0.01 | 74.6 | 200 | 95 | 2.4 |
| 5 | 1 | G1 | CT1-3 | Po-2 Po-26 | PTFE-5 | 0.22 | 86.4 | 200 | 98 | 2.5 |
| 6 | 1 | G1 | *1 | Po-24 Po-36 | PTFE-6 | 0.12 | 89.1 | 200 | 107 | 1.6 |
| 7 | 1 | G1 | CT1-3 | Po-2 Po-26 | PTFE-7 | 0.12 | 91.3 | 200 | 107 | 2.3 |
| 8 | 4 | G1 | CT1-2 | Po-10 Po-32 | PTFE-1 | 0.12 | 82.2 | 100 | 92 | 1.9 |
| 9 | 1 | G1 | CT1-3 | Po-2 Po-26 | PTFE-1 | 0.12 | 82.2 | 50 | 87 | 2.7 |
| 10 | 5 | G1 | *1 | Po-2 Po-26 | PTFE-1 | 0.12 | 82.2 | 300 | 118 | 1.2 |
| 11 | 6 | G1 | CT1-5 | Po-2 Po-26 | PTFE-1 | 0.12 | 82.2 | 400 | 125 | 1.1 |
| 12 | 1 | G1 | CT1-4 | Po-2 Po-26 | H | 0.12 | 45 | 200 | 110 | 1.8 |

(**) Number average diameter of primary particles

Content of the interlayer in Table 1 is shown in Table 2.

G2, G2 and G3 in Table 1 are the following CGM.

G1: Hydroxy gallium phthalocyanine pigment having the specific peak of Bragg angle 2θ (±0.2) at least at 7.5°, 9.9°, 12.5°, 16.3°, 18.6°, 25.1° and 28.1° based on a Cu—Kα characteristic X-ray diffraction spectrum measurement.

G2: Chloro gallium phthalocyanine pigment having the specific peak of Bragg angle 2θ (±0.2) at least at 7.4°, 16.3°, 18.6°, 25.5° and 28.3° based on a Cu—Kα characteristic X-ray diffraction spectrum measurement.

G3: Gallium phthalocyanine pigment having the specific peak of Bragg angle 2θ (±0.2) at least at 6.8°, 12.8°, 15.8°, and 26.6° based on a Cu—Kα characteristic X-ray diffraction spectrum measurement.

In Table 1, *1 shows mixed CTMs of CT1-2 and CT2-2 in a ratio of 6/2 are used.

In Table 1, PTFE and H represent the following fluororesin fine particle.

PTFE: Polyethylene terephthalate resin particle

H: Trifluoroethylene terephthalate resin particle

The contact angle and the absolute value of variation of contact angle are measured by the foregoing method and the variation of contact angle is represented by absolute value.

TABLE 2

| Interlayer No. | Interlayer N-type semiconductor and surface treatment: Species of particles | Primary particle diameter (nm) | Compound used in surface treatment |
|---|---|---|---|
| 1 | A1 | 35 | 1* |
| 2 | A1 | 35 | 2* |
| 3 | A1 | 35 | 3* |
| 4 | A2 | 35 | 4* |
| 5 | A2 | 35 | 5* |
| 6 | A1 | 35 | 6* |

| Interlayer No. | Interlayer: Binder resin: Species | Heat of fusion (J/g) | Water absorption | Ratio of structural unit (**) (mol %) | Volume Ratio Vn/Vb | Thickness (μm) |
|---|---|---|---|---|---|---|
| 1 | N-1 | 0 | 1.9 | 100 | 1.0 | 3.0 |
| 2 | N-2 | 0 | 2.0 | 100 | 0.7 | 3.0 |
| 3 | N-3 | 0 | 2.8 | 45 | 1.0 | 3.0 |
| 4 | N-1 | 0 | 1.9 | 100 | 1.0 | 5.0 |
| 5 | N-1 | 0 | 1.9 | 100 | 2.3 | 10.0 |
| 6 | N-1 | 0 | 1.9 | 100 | 1.0 | 1.0 |

() Ratio of structural unit () having 7 or more carbons (mol %)

Volume ratio of the interlayer in Table 2 shows volume ratio of the binder resin Vn to the N-type semiconductor material Vb, wherein the interlayer is formed varying the ration but keeping total volume of them constant.

In Table 2,

A1, A2 and Z show rutyl-type titanium oxide, anatase-type titanium oxide and zinc oxide, respectively,

*2 is copolymer of methylhydrogensiloxane and dimethylsiloxane whose molecular ratio of 1:1,

*3 is copolymer of methylhydrogensiloxane and dimethylsiloxane whose molecular ratio of 2:8,

*4 is copolymer of ethylhydrogensiloxane and dimethylsiloxane whose molecular ratio of 1:1,

*5 is copolymer of methylhydrogensiloxane and methylethylsiloxane whose molecular ratio of 1:1, and

*6 is methylhydrogenpolysiloxane.

In Table 2, "surface treatment" is a substance used in the surface treatment of the particles, and The heat of fusion and the water absorbing degree were measured as follows:

Measurement of Heat of Fusion

Measuring apparatus: Shimadzu Flow Rate Differential Scanning Calorimeter DSC-50 manufactured by Shimadzu Corporation.

Measuring condition: The sample to be measured was set in the measuring apparatus and measurement was stated at a room temperature (24° C.). The temperature was raised by 200° C. in a rate of 5° C. per minute and then cooled by the room temperature in a rate of 5° C. per minute. Such the operation was repeated two times and the heat of fusion was calculated from the area of the endothermic peak caused by the fusion in the course the secondary temperature rising.

Measuring condition of water absorption degree

The sample to be measured was satisfactorily dried at a temperature of from 70 to 80° C. spending 3 to 4 hours and the sample was precisely weighed. After that the sample was put into deionized water kept at 20° C. and taken out after a designated period and water adhered at the surface of the sample was wiped off by a clean cloth, and then the sample was weighed. Such the operation was repeated until the increasing of the weight was saturated. Thus measured increased weight of the sample was divided by the initial weight. The quotient was defined as the water absorption degree.

In the Table 2, "Ratio of structural unit having 7 or more carbon atoms" is the ratio in mole-% of the structural unit having 7 or more carbon atoms between the amide bonds in the structural unit.

<Evaluation>

The obtained photoreceptor was mounted in a commercial color printer magicolor2200DeskLaser (made by Minolta QMS company), and durability test was performed. In detail, total 20,000 sheets of a character image and a halftone image were printed, and the evaluation was conducted at the start time and for every 5000 sheets. Evaluation items and criterion for evaluation are shown as follows.

Process condition of the above-mentioned color printer was made into the following conditions.

Charging device: Saw-tooth electrode

Light-exposure device: Semiconductor laser

Developing: Nonmagnetic toner with an average particle diameter of 6.5 μm, toner containing external additive agent of 0.3 μm strontium titanate and 15 nm hydrophobic silica Reversal Development Method Transfer: Intermediate transfer roller use Cleaning: Cleaning blade Fixing: Heating fixing Process speed: 100 mm/sec Image density The reflective density of the image was measured by a densitometer RD-918, manufactured by Macbeth Co., Ltd., the density was expressed by a relative value when the reflective density of the paper was set at 0. The image density was lowered accompanied with a lot of printing. The measurement was carried out for the black solid image of printed after 20,000 sheets of printing.

A: The density was more than 1.2; good.

B: The density was from 1.0 to 1.2; the level on which no problem was caused in the practical use.

C: The density was less than 1.0; the level on which a problem was caused in the practical use.

Cracking

A: No crack on the surface of the photoreceptor was observed; good.

B: Minute cracks on the surface of the photoreceptor was observed, but no marks due to the cracks on the printed sheet was observed; the level on which no problem was caused in the practical use.

C: Cracks on the surface of the photoreceptor was observed, and uneven image due to the cracks on the printed sheet was observed; the level on which a problem was caused in the practical use.

Toner Filming

A: No toner filming on the surface of the photoreceptor was observed through 20,000 prints.

B: Minute toner filming on the surface of the photoreceptor was observed, but no uneven images corresponding to the toner filming was observed on the printed sheet through 20,000 prints.

C: Toner filming on the surface of the photoreceptor was observed during 20,000 sheets printing, and uneven images in a half-tone image corresponding to the toner filming was observed on the printed sheet.

Dash Mark

The occurrence state of the dash marks on the halftone image corresponding to photoreceptor cycles was judged according to the following norms.

A: Dash marks more than 0.4 mm was observed less than 5 per A4 print sheet; good.

B: Dash marks more than 0.4 mm was observed between 6 and 10 per A4 print sheet; no problem was caused in practical use.

C: Dash marks more than 0.4 mm was observed more than 11 per A4 print sheet; a problem was caused in the practical use.

Image Blurring

A: No blur occurred at al through 20,000 prints, good.

B: Partially image blurring occurred on some prints (less than 10 sheets) among the 20,000 prints but no problem was caused in practical use.

C: Partially image blurring occurred on 10 or more prints or image blurring in wide area occurred on 1 or more prints among the 20,000 prints; a problem was caused in practical use.

Sharpness

Criteria of the sharpness was as follows.

A: Characters of 4 points or less is printed definitely to read easy; good.

B: Characters of 6 points or less is printed definitely to read easy; no problem was caused in practical use.

C: Characters of 8 points or less is printed definitely to read easy; evaluation is required again.

D: Part of characters of 8 points is not printed definitely to read with difficulty; a problem was caused in the practical use.

TABLE 3

| Photo-receptor No. | Image density | Crack | Dash mark | Toner filming | Image blurring | Sharpness |
|---|---|---|---|---|---|---|
| 1 | A | A | B | A | A | A |
| 2 | A | A | A | A | A | A |
| 3 | A | A | B | A | A | A |
| 4 | B | B | C | B | B | D |
| 5 | B | B | C | C | B | D |
| 6 | A | A | A | A | A | A |
| 7 | B | B | C | C | B | B |
| 8 | A | A | B | A | A | B |
| 9 | B | C | C | C | A | B |
| 10 | A | A | A | A | A | A |
| 11 | A | A | A | B | A | B |
| 12 | A | B | B | B | A | A |

The result shown in Table 3 demonstrate as follows. Photoreceptors 1-3, 6, 8, 10-12, in which a surface layer (CTL 2) contains polyarylate of formula (1) and fluororesin particles having primary particle diameter of 0.02-0.2 μm and crystallinity of 90% or more, and has contact angle against water of 90° or more and its absolute value of a variation being 2.0°, have improved image density, cracking, toner filming, dash mark, image blurring and sharpness. Contrarily Photoreceptor 4, containing fluororesin particle PTFE-4 having primary particle diameter of 0.01 μm has larger absolute value of a variation of contact angle of 2.4° and shows inferior result in dash mark and sharpness. Photoreceptor 5, containing fluororesin particle PTFE-5 having primary particle diameter of 0.22 μm has larger absolute value of a variation of contact angle of 2.5° and shows inferior result in dash mark and toner filming. Photoreceptor 7 containing PTFT-7 having crystallinity of 91.3% shows larger absolute,value of a variation of contact angle of 2.3° and shows inferior result in dash mark and sharpness. Photoreceptor 9, whose contact angle of 87° employing smaller amount of PTFE-1 shows inferior result in dash mark, toner filming and sharpness.

Example 2

In production of the photoreceptor 1, photoreceptors 21-32 were produced in the similar way with the photoreceptor 1 except that CTM of the charge transporting layer was changed as shown in Table 4.

TABLE 4

| Photoreceptor No. | Interlayer No. | CGM in CTL | CTM in CTL 1 and 2 | Polyarylate | Fluororesin particle in CTL 2: Kind of fluororesin particle | Primary particles (μm) (**) | Crystallinity (%) | Adding amount (parts) | Contact angle (°) | Variation of contact angle (\|°\|) |
|---|---|---|---|---|---|---|---|---|---|---|
| 201 | 1 | G1 | CT2-2 | Po-2 Po-26 | PTFE-1 | 0.12 | 82.2 | 200 | 113 | 1.4 |
| 222 | 2 | G2 | *2 | Po-2 Po-26 | PTFE-2 | 0.03 | 73.4 | 200 | 115 | 0.8 |
| 223 | 3 | G3 | CT2-4 | Po-1 Po-30 | PTFE-3 | 0.19 | 86.2 | 200 | 108 | 1.8 |
| 224 | 1 | G1 | CT2-2 | Po-2 Po-26 | PTFE-5 | 0.22 | 86.4 | 200 | 102 | 2.6 |
| 225 | 1 | G1 | *12 | Po-24 Po-36 | PTFE-6 | 0.12 | 89.1 | 200 | 106 | 1.6 |
| 226 | 1 | G1 | CT2-2 | Po-2 Po-26 | PTFE-7 | 0.12 | 91.3 | 200 | 105 | 2.4 |
| 227 | 4 | G1 | CT2-1 | Po-10 Po-32 | PTFE-1 | 0.12 | 82.2 | 100 | 94 | 1.8 |
| 228 | 1 | G1 | CT2-2 | Po-2 Po-26 | PTFE-1 | 0.12 | 82.2 | 50 | 85 | 2.5 |
| 229 | 5 | G1 | *2 | Po-2 Po-26 | PTFE-1 | 0.12 | 82.2 | 300 | 126 | 1.1 |
| 320 | 6 | G1 | CT2-5 | Po-2 Po-26 | PTFE-1 | 0.12 | 82.2 | 400 | 128 | 1.4 |
| 321 | 1 | G1 | CT2-3 | Po-2 Po-26 | H | 0.12 | 45 | 200 | 108 | 1.7 |

(**) Number average diameter of primary particles

In Table 4, *2 shows mixed CTMs of CT2-2 and CT1-3 in a ration of 6/2 are used.

TABLE 5

| Photo-receptor No. | Image density | Crack | Dash mark | Toner filming | Image blurring | Sharpness |
|---|---|---|---|---|---|---|
| 21 | A | A | A | A | A | A |
| 22 | A | A | B | A | A | A |
| 23 | A | A | B | A | A | A |
| 24 | B | B | C | B | B | D |
| 25 | B | B | C | C | B | D |
| 26 | A | A | A | A | A | A |
| 27 | B | B | C | C | B | B |
| 28 | A | A | B | A | A | B |
| 29 | B | C | C | C | A | B |
| 30 | A | A | A | A | A | A |
| 31 | A | A | A | B | B | B |
| 32 | A | B | B | B | A | A |

The result shown in Table 5 demonstrate as follows. Photoreceptors 21-23, 26, 28, 30-32, in which a surface layer (CTL 2) contains polyarylate of formula (1) and fluororesin particles having primary particle diameter of 0.02-0.2 μm and crystallinity of 90% or more, and has contact angle against water of 90° or more and its variation of the contact angle of 2.0°, have improved image density, cracking, toner filming, dash mark, image blurring and sharpness. Contrarily Photoreceptor 24, containing fluororesin particle PTFE having primary particle diameter of 0.01 μm has larger absolute value of a variation of contact angle of 2.4° and shows inferior result in dash mark and sharpness. Photoreceptor 25, containing fluororesin particle PTFR-5 having primary particle diameter of 0.22 μm has larger absolute value variation of the contact angle 2.6° and shows inferior result in dash mark, toner filming and sharpness. Photoreceptor 27 containing PTFT-7 having crystallinity of 91.3% shows larger absolute value of a variation of contact angle of 2.4 and shows inferior result in dash mark and sharpness. Photoreceptor 29, whose contact angle of 85° employing smaller amount of PTFE-1 shows inferior result in crack, toner filming and dash mark.

Example 3

Manufacture of photoreceptor 201

The photoreceptor 201 was produced as follows.

The surface of cylinder type aluminum base support was subjected to a cutting process, and a conductive base support of surface roughness Rz=1.5 (μm) was prepared.

<Intermediate Layer>

The following intermediate layer dispersion liquid was diluted twice with the same mixed solvent, and filtered after settling for overnight (filter; Nihon Pall Ltd. RIGIMESH 5 μm filter manufactured by Pall Corporation), whereby the intermediate layer coating composition was produced.

| | |
|---|---|
| Polyamide resin CM8000 (made by Toray Industries, Inc.) | 1 part |
| Inorganic particles: Titanium oxide (number average primary particle diameter of 35 nm: titanium oxide subjected to a silica alumina process and a methyl hydrogen polysiloxane process) | 3 parts |
| Methanol | 10 parts |

The above-mentioned composites were mixed, dispersion was performed for 10 hours by a batch system, using a sand mill as a homogenizer, and whereby intermediate layer dispersion liquid was produced.

On the above-mentioned base support, the above-mentioned coating composition was coated so that it became 1.0 μm of thickness of dried coating.

| <Electric charge generating layer (CGL)> | |
|---|---|
| Electric charge occurrence material (CGM): oxititanyl phthalocyanine (titanylphthalocyanine which has the maximum diffraction peak at 27.3° of the Bragg angle (2θ ± 0.2°) by X-ray diffraction spectrum with Cu—Kα characteristic-X-rays) | 24 parts |
| Polyvinyl butyral resin "S-LEC BL-1" (made by Sekisui Chemical Co., Ltd.) | 12 parts |
| 2-butanone/cyclohexanone = 4/1 (v/v) | 300 parts |

The above-mentioned compositions were mixed and dispersed using the sand mill, thereby a charge generation layer coating composition was prepared. This coating liquid was applied by a dip coating method on the interlayer, thereby an electric charge generating layer of 0.5 μm dry film thickness was formed.

| <Charge transporting layer 1 (CTL1)> | |
|---|---|
| Electric charge transportation material (4,4'-dimethyl-4''-(α-phenyl styryl)triphenylamine) | 225 parts |
| Polycarbonate (Z300: manufactured by a Mitsubishi Gas Chemical Company INC. company) | 300 parts |
| Antioxidant (Irganox1010: made by Ciba-Geigy Japan) | 6 parts |
| Dichloromethane | 2000 parts |
| Silicone oil (KF-54: made by Shin-Etsu Chemical Co., Ltd. company) | 1 Part |

The above-mentioned compositions were mixed and dissolved, thereby a charge transporting layer coating composition 1 was prepared. This coating composition was coated on the above-mentioned charge generation layer by the immersion coating method, and was subjected to a dry process at 110° C. for 70 minutes, whereby the charge transporting layer of 18.0 μm of dried coating layer thickness was formed.

<Preparation of Polytetrafluoroethylene Resin Particle (PTFE Particles) Dispersion Liquid>

PTFE particles (PTFE particles having a number average primary particle diameters of 0.12 μm and a degree of crystallinity 91.3) were heat-treated for 40 minutes at 250° C. to make the degree of crystallinity to 82.8, and the following PTFE particle dispersion liquid was prepared using the PTFE particles.

| | |
|---|---|
| PTFE particles (PT1: number average primary particle diameters of 0.12 μm, and degree of crystallinity of 82.8) | 200 parts |
| Toluene | 600 parts |
| Fluorine based comb type graft polymer (a product name GF300, manufactured by Toagosei Co., Ltd. Chemistry) | 15 parts |

After mixing the above-mentioned compositions, the resultant mixture was dispersed with a sand grinder (manufactured by Amex company) using glass bead, and whereby PTFE particle dispersion liquid was prepared.

| <Charge transporting layer 2 (CTL2)> | |
|---|---|
| PTFE particle dispersion liquid | 815 parts |
| Electric charge transportation materials (4,4'-dimethyl-4"-(α-phenyl styryl)triphenylamine) | 150 parts |
| Siloxane-modified polycarbonate resin (PC-1) | 150 parts |
| Polycarbonate (Z300: manufactured by a Mitsubishi Gas Chemical Company INC. company) | 150 parts |
| Antioxidant (Irganox1010: made by Ciba-Geigy Japan) | 12 parts |
| THF: Tetrahydrofuran | 2800 parts |
| Silicone oil (KF-54: made by Shin-Etsu Chemical Co., Ltd. company) | 4 Parts |

The above-mentioned compositions were mixed and dissolved, thereby a charge transporting layer 2 coating composition was prepared. This coating composition was coated on the above-mentioned charge transporting layer by a circular slide hopper type coating apparatus, and was subjected to a dry process at 110° C. for 70 minutes, whereby the charge transporting layer of 2.0 μm of dried coating layer thickness was formed.

Production of Photoreceptors 202-211

In production of the photoreceptor 201, photoreceptors 202-211 were produced in the similar way with the photoreceptor 1 except that a kind and added amount of fluorine based resin particles of the charge transporting layer 2 (CTL2) were changed as shown in Table 21.

TABLE 21

| Photoreceptor No. | Charge transporting layer 2: Kinds of fluorine based resin particle | Number average primary order particle diameter (μm) | Crystallinity (%) | Added amount (parts) | Contact angle (°) | Variation of contact angle (\|°\|) |
|---|---|---|---|---|---|---|
| 201 | PTFE-1 | 0.12 | 82.2 | 200 | 112 | 1.4 |
| 202 | PTFE-2 | 0.03 | 73.4 | 200 | 115 | 0.8 |
| 203 | PTFE-3 | 0.19 | 86.2 | 200 | 108 | 1.8 |
| 204 | PTFE-5 | 0.22 | 86.4 | 200 | 98 | 2.3 |
| 205 | PTFE-6 | 0.12 | 89.1 | 200 | 107 | 1.6 |
| 206 | PTFE-7 | 0.12 | 91.3 | 200 | 105 | 2.2 |
| 207 | PTFE-1 | 0.12 | 82.2 | 100 | 92 | 1.9 |
| 208 | PTFE-1 | 0.12 | 82.2 | 50 | 88 | 2.4 |
| 209 | PTFE-1 | 0.12 | 82.2 | 300 | 118 | 1.2 |
| 210 | PTFE-1 | 0.12 | 82.2 | 400 | 128 | 1.0 |
| 211 | H | 0.12 | 45.0 | 200 | 108 | 1.8 |

In Table 21, PTFE, and H show the following fluorine based resin fine particles.

PTFE: Polyethylene-terephthalate-resin particles

H: Copolymerization resin particles of ethylene trifluoride-ethylene tetrafluoride Moreover, contact angle and variation in contact angle in Table 21 were measured by the above mentioned method.

A toner and a developer employing the toner were prepared.

Preparation of Latex

A solution previously prepared by dissolving 7.08 g of anionic surfactant (sodium dodecylbenzenesulfonate: SDS) in 2.760 g of deionized water was put into a 5,000 ml separable flask on which a stirrer, a thermal sensor, a cooler and a nitrogen introducing device were attached. The interior temperature of the flask was raised by 80° C. while stirring at 230 rpm under nitrogen gas stream. On the other hand, 72.0 g of Exemplified Compound 19 was added to monomer mixture composed of 115.1 g of styrene, 42.0 g of n-butyl acrylate and 10.9 g of methacrylic acid and dissolved by heating at 80° C. to form a monomer liquid.

The above monomer liquid was mixed with and dispersed in the foregoing surfactant solution by a mechanical dispersing machine having a circulation pass at the heated state to prepare emulsified particles having a uniform particle size. To the resultant emulsion, a solution prepared by dissolving 0.84 g of a polymerization initiator (potassium persulfate: KPS) was added and heated and stirred at 80° C. for 3 hours to form latex particles.

Moreover, a solution prepared by dissolving 7.73 g of the polymerization initiator (KPS) in 240 ml of deionized water was added to the resultant latex. After 15 minutes, a mixture of 383.6 g of styrene, 140.0 g of n-butyl acrylate, 36.4 g of methacrylic acid and 14.0 g of n-octyl-3-mercaptopropionic acid ester was dropped spending for 120 minutes. The latex was further stirred for 60 minutes after the completion of the dropping, and then cooled by 40° C. to obtain latex particles. The resultant latex particle was referred to as Latex 1.

Example of Toner Preparation

Preparation of Colored Particle 1

In 160 ml of deionized water, 9.2 g of sodium n-dodecylsulfate was dissolved. To the resultant solution, 20 g of carbon black Regal 330R, manufactured by Cabot Co., Ltd., was gradually added while stirring, and then dispersed by a dispersion machine CLEARMIX. The particle diameter of the above suspension was 112 nm in terms of weight average as a result of measurement by an electrophoretic light scattering photometer ESL-800, manufactured by Ootsuka Denshi CO., Ltd. The suspension was referred to as Colorant Dispersion 1.

After that, 1,250 g of Latex 1, 2,000 ml of deionized water and the above Colorant Dispersion 1 were put into a 5 liter four-mouth flask on which a thermal sensor, a cooler, a nitrogen introducing device and a stirrer were attached. After adjusting the temperature at 30° C., the pH of the liquid was adjusted to 10.0 by adding a 5 mole/liter solution of sodium hydroxide.

And then, absolution prepared by dissolving 52.6 g of magnesium chloride hexahydrate in 72 ml of deionized water was added to the above liquid spending 5 minutes at 30° C. while stirring. After standing for 2 minutes, the liquid was heated by 90° C. spending 5 minutes in a rate of 12° C./minute. In such the state, the particle size was measured by Coulter Counter TA-II, and a solution prepared by dissolving 115 g of sodium chloride in 700 ml of deionized water was added for stopping the particle growth at a time when the volume average particle diameter was reached at 4.3 μm. The liquid was further stirred at 85±2° C. for 8 hours for salting out/fusing the particles.

Thereafter, the liquid was cooled in a rate of 6° C./minute and hydrochloric acid was added for adjusting the pH to 2.0, and the stirring was stopped. The resultant colored particles was filtered/washed under the following condition, and then dried by air of 40° C. to obtain colored particles. The particles were referred to as Colored Particle 1.

Preparation of Colored Particles 2 through 11

Colored Particles 2 through 11 were prepared in the same manner as in Colored Particle 1 except that the preparation conditions relating to the salt out/fusion were varied as listed in Table 22.

TABLE 22

| Colored particle No. | Adding amount of magnesium chloride | Temperature raising rate | Salt out/Fusion Liquid temperature | Salt out/Fusion Holding time | Particle diameter at stop of growing (μm) |
|---|---|---|---|---|---|
| Colored Particle 1 | 52.6 g | 12° C./minute | 85 ± 2° C. | 8 hours | 4.3 |
| Colored Particle 2 | 52.6 g | 20° C./minute | 90 ± 2° C. | 6 hours | 4.3 |
| Colored Particle 3 | 52.6 g | 5° C./minute | 90 ± 2° C. | 6 hours | 4.1 |
| Colored Particle 4 | 26.3 g | 12° C./minute | 85 ± 2° C. | 8 hours | 4.3 |
| Colored Particle 5 | 78.9 g | 12° C./minute | 85 ± 2° C. | 8 hours | 4.3 |
| Colored Particle 6 | 52.6 g | 12° C./minute | 85 ± 2° C. | 8 hours | 3.5 |
| Colored Particle 7 | 38.6 g | 12° C./minute | 85 ± 2° C. | 8 hours | 3.4 |
| Colored Particle 8 | 78.9 g | 12° C./minute | 85 ± 2° C. | 8 hours | 3.2 |
| Colored Particle 9 | 52.6 g | 12° C./minute | 85 ± 2° C. | 8 hours | 5.6 |
| Colored Particle 10 | 45.8 g | 12° C./minute | 85 ± 2° C. | 8 hours | 6.8 |
| Colored Particle 11 | 52.6 g | 12° C./minute | 85 ± 2° C. | 8 hours | 8.9 |

To each of the Colored Particles 1 through 11, 1 weight-% of hydrophobic silica (number average primary particles; 12 nm, hydrophobicity: 68), 1 weight-% of hydrophobic titanium oxide (number average primary particles: 20 nm, hydrophobicity: 63) were added and mixed by a Henschel mixer to prepare toners. These toners were referred to as Toners 1 through 11. The average particle diameter and the particle size distribution were measured and listed in Table 23.

The physical properties such as the average particle size and the particle size distribution were substantially the same even when the measurement was performed either with respect to the colored particle as the raw material of the tone or the tone (usually containing an external additive together with the colored particle).

Preparation of Developer

Developers 1 through 11 for evaluation were prepared by mixing 10 parts by weight of each of Toners 1 through 11 with 100 parts by weight of ferrite carrier of 45 μm covered with styrene-methacrylate copolymer.

<<Evaluation>>

Thus obtained photoreceptor and the developer were installed in the combination given in Table 24 into a Color printer available on the market MAGICOLOR 2200 Desk Laser, manufactured by Minolta QSM Co., Ltd., and subjected to durability test. The evaluation was carried out by printing of 20,000 sheets in total, in which an original picture including a solid image, a character image and a halftone image was printed at the initial print and every 5,000$^{th}$ prints. The items and the norms of the evaluation are described below.

The processing conditions in the above color printer were as follows.

Charging device: Saw tooth electrode

Exposing device: Semiconductor laser (Emission wavelength: 405 nm)

Development: Reversal development

Transfer: Intermediate transfer belt

Cleaning: Cleaning blade

Fixing: Thermal fixing

Processing speed: 100 mm/second

Image Density

The reflective density of the image was measured by a densitometer RD-918, manufactured by Macbeth Co., Ltd., the density was expressed by a relative value when the

TABLE 23

| Toner No. | Volume average particle diameter of 50% (Dv50) (μm) | Number average particle diameter of 50% (Dp50) (μm) | Dv50/Dp50 | Volume average particle diameter of accumulate of 75% (Dv75) (μm) | Number average particle diameter of accumulate of 75% (Dp75) (μm) | Dv75/Dp75 | Percentage of number of particles of 0.7 × Dp50 |
|---|---|---|---|---|---|---|---|
| Toner 1 | 4.6 | 4.3 | 1.07 | 4.1 | 3.8 | 1.08 | 7.8 |
| Toner 2 | 4.8 | 4.5 | 1.07 | 4.2 | 3.7 | 1.14 | 5.5 |
| Toner 3 | 4.4 | 4.0 | 1.10 | 4.0 | 3.4 | 1.18 | 8.2 |
| Toner 4 | 4.6 | 3.7 | 1.24 | 4.0 | 3.1 | 1.29 | 13.6 |
| Toner 5 | 4.7 | 4.3 | 1.09 | 4.1 | 3.6 | 1.14 | 6.3 |
| Toner 6 | 3.5 | 3.1 | 1.13 | 3.1 | 2.8 | 1.11 | 6.8 |
| Toner 7 | 3.8 | 3.4 | 1.12 | 3.3 | 2.7 | 1.23 | 12.4 |
| Toner 8 | 3.6 | 3.3 | 1.09 | 3.1 | 2.8 | 1.11 | 6.3 |
| Toner 9 | 5.8 | 5.3 | 1.09 | 5.1 | 4.5 | 1.13 | 8.4 |
| Toner 10 | 7.1 | 6.4 | 1.11 | 6.3 | 5.3 | 1.19 | 11.0 |
| Toner 11 | 9.3 | 8.8 | 1.06 | 7.9 | 6.9 | 1.14 | 6.3 |

reflective density of the paper was set at 0. The image density was lowered accompanied with a lot of printing. The measurement was carried out for the black solid image of printed after 20,000 sheets of printing.

A: The density was more than 1.2; good.

B: The density was from 1.0 to 1.2; the level on which no problem was caused in the practical use.

C: The density was less than 1.0; the level on which a problem was caused in the practical use.

Fog

The reflective fog density of the white solid image was measured as the fog by D-918, manufactured by Macbeth Co., Ltd. The reflective fog density was evaluated by the relative density when the density of A4 size paper before printing was set at 0.0. The measurement was carried out at the white solid image printed after 20,000 sheets of printing.

A: The density was less than 0.010; good.

B: The density was from 0.010 to 0.020; the level on which no problem was caused in the practical use.

C: The density was more than 0.020; the level on which a problem was caused in the practical use.

Dash Mark

The occurrence state of the dash marks on the halftone image was judged according to the following norms.

A: No nucleus of dash mark was observed on the photoreceptor and no dash mark occurred on the halftone image; good.

B: Dash mark nuclei were observed on the photoreceptor but no dash mark occurred on the halftone image; no problem was caused in practical use.

C: Dash mark nuclei were observed on the photoreceptor and dash marks occurred on the halftone image; a problem was caused in the practical use.

Sharpness Criteria of the sharpness was as follows.

A: Characters of 4 points or less is printed definitely to read easy; good.

B: Characters of 6 points or less is printed definitely to read easy; no problem was caused in practical use.

C: Characters of 8 points or less is printed definitely to read easy; evaluation is required again.

D: Part of characters of 8 points is not printed definitely to read with difficulty; a problem was caused in the practical use.

TABLE 24

| Combination No. | Photoreceptor No. | Developer No. | Image density | Fog | Dash mark | Image unevenness | Image blurring | Sharpness |
|---|---|---|---|---|---|---|---|---|
| 1 | 201 | 1 | A | A | A | A | A | A |
| 2 | 201 | 2 | A | A | A | A | A | A |
| 3 | 201 | 3 | A | B | A | B | A | B |
| 4 | 201 | 4 | A | C | C | B | A | C |
| 5 | 201 | 5 | A | A | A | A | A | A |
| 6 | 201 | 6 | A | A | A | A | A | A |
| 7 | 201 | 7 | A | C | C | B | A | B |
| 8 | 201 | 8 | A | A | A | A | A | A |
| 9 | 201 | 9 | A | A | A | B | A | B |
| 10 | 201 | 10 | A | C | C | B | B | B |
| 11 | 201 | 11 | B | B | B | B | A | B |
| 12 | 202 | 1 | A | A | A | A | A | A |
| 13 | 203 | 1 | A | A | A | A | B | B |
| 14 | 204 | 1 | B | A | C | B | C | C |
| 15 | 205 | 1 | B | A | A | A | B | B |
| 16 | 206 | 1 | B | A | C | C | A | C |
| 17 | 207 | 1 | A | A | B | A | A | B |
| 18 | 208 | 1 | B | A | C | C | A | C |
| 19 | 209 | 1 | A | A | A | A | A | A |
| 20 | 210 | 1 | B | A | A | B | B | B |
| 21 | 211 | 1 | B | A | B | B | A | B |

Unevenness in Image

A: Any unevenness was not caused in the halftone image through 20,000 copies.

B: Slight stripe-shaped unevenness were observed on the photoreceptor surface but not observed at all in the halftone image.

C: Strip-shaped unevenness meeting with the damage on the photoreceptor surface was clearly observed on the entire surface of the halftone image during the 20,000 prints.

Image Blurring

A: No blur occurred at al through 20,000 prints, good.

B: Partially image blurring occurred on some prints (less than 10 sheets) among the 20,000 prints but no problem was caused in practical use.

C: Partially image blurring occurred on 10 or more prints or image blurring in wide area occurred on 1 or more prints among the 20,000 prints; a problem was caused in practical use.

As is shown in Table 24, Combinations 1 to 3, 5 to 9 or 11, which are combinations of organic Photoreceptor No. 201 with each of Developers No. 1 to 3, 5 to 9 and 11, each gives good electrophotographic image improved in the unevenness, blur, dash mark and sharpness. Photoreceptor No. 201 contains the fluororesin particles having an average primary particle diameter of from 0.02 μm to less than 0.20 μm and the binder resin, and had the surface later (Charge transfer layer 2) a contact angle with water of not less than 90° and an absolute value of variation of the contact angle of not more than 2.2°, Developers No. 1 to 3, 5 to 9 and 11 each contains the toner in which the number of the toner particle having the diameter not more than 0.7×(Dp50) was not more than 10% when the diameter of 50% in number of the toner particle is Dp50. The combination of Developer 1 satisfying the requirements of the invention and the organic photoreceptor containing the fluororesin fine particles having an average primary particle diameter of not less than 0.02 μm and less than 0.20 μm and a crystallinity of less than 90% and the binder resin and having a contact angle with water of not less than 90° and an absolute value of a variation of the contact angle is within 2.2°, namely Combinations No. 12, 13, 16, 18, 20 to 22, gave good electrophotographic images improved in the unevenness, blur, dash mark and sharpness. The fog and the dash marks were caused and the sharpness was lowered by Combination 4, and the degradation of the image quality caused by the occurrence of the fog and the dash marks were observed by Combinations 4, 7 or 10 each employing Developer No. 4, 7, or 10 each not satisfying the conditions of the invention even when these toners were each combined with Photoreceptor No. 201 satisfying the requirements of the invention such as Combination 4, 7, and 10.

On the other hand, the dash marks were caused by Combination 14 employing Photoreceptor 204 in which the fluororesin particles having an average primary particle diameter of 0.01 μm and the dispersibility of the fluororesin particle was not suitable and the absolute value of variation of contact angle was as large as 2.2°. The dash marks and image blurring were caused and the sharpness was lowered by Combination No. 15 employing Photoreceptor 205 in which the fluororesin particles having an average primary particle diameter of 0.22 μm was used and the absolute value of a variation of contact angle was as large as 2.3°. The dash marks and image blurring were caused and the sharpness was lowered by Combination No. 17 employing Photoreceptor 207 in which the fluororesin particles having a crystallinity of 91.3% was used, and the spreading ability of the fluororesin particle was insufficient and the absolute value of a variation of contact angle was as large as 2.2°. The dash marks and image blurring were caused and the sharpness was lowered by Combination No. 19 employing Photoreceptor 209 in which the content of the fluororesin particle is reduced and the contact angle was as low as 88° and the absolute value of a variation of contact angle was as large as 2.4°.

What is claimed is:

1. An image forming method comprising the steps of; forming a latent image by exposing an organic photoreceptor to light, and developing the latent image by a developer containing a toner to form a toner image, wherein the organic photoreceptor has a surface layer comprising an polyarylate binder and fluororesin fine particles having an average primary particle diameter of not less than 0.02 μm and less than 0.20 μm and a crystallinity of less than 90%.

2. The image forming method of claim 1, wherein an absolute value of a variation of the contact angle is less than 2.0°.

3. The image forming method of claim 1, wherein the polyarylate resin is represented by following formula, (1)

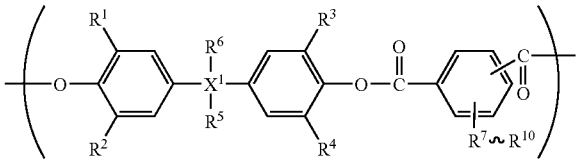

wherein $X^1$ is a carbon atom or a simple bond; $R^1$ through $R^4$ each is a hydrogen or halogen atom, or an alkyl or aryl group which may have a substituent; $R^5$ and $R^6$ each is a hydrogen or halogen atom, or an alkyl or aryl group which may have a substituent, or an alkylidene formed by bonding $R^5$ and $R^6$; $R^7$ through $R^{10}$ is a hydrogen or halogen atom, or an alkyl or aryl group which may have a substituent.

4. The image forming method of claim 1, wherein a number average molecular weight of a polymer of the fluorine resin fine particles is 10,000 to 1,000,000.

5. The image forming method of claim 1, wherein the crystallinity of the fluorine resin fine particles is 40% or more.

6. The image forming method of claim 1, wherein the toner comprises a releasing agent represented by Formula:

$$R^1—(OCO—R^2)_n$$

wherein n is an integer from 1 to 4, preferably from 2 to 4, and more preferably 3 or 4, $R^1$ and $R^2$ each represents a hydrocarbon group, which may have a substituent.

7. An image forming method comprising the steps of; forming a latent image by exposing an organic photoreceptor to light, and developing the latent image by a developer containing a toner to form a toner image, wherein the organic photoreceptor has a surface layer comprising a binder and fluororesin fine particles having an average primary particle diameter of not less than 0.02 μm and less than 0.20 μm and a crystallinity of less than 90%, and has a contact angle for water of 90° or more; and the toner comprises 10 number percents or less of toner particles having particle diameter below 0.7×(Dp50), wherein Dp50 represents 50% number particle diameter.

8. The image forming method of claim 7, wherein an absolute value of a variation of the contact angle is less than 2.0°.

9. The image forming method of claim 7, wherein toner particles of the toner have a ratio (Dv50/Dp50) being 1.0-1.15, wherein Dv50 is 50% volume particle diameter and Dp50 is 50% number particle diameter.

10. The image forming method of claim 7, wherein toner particles of the toner have a ratio (Dv75/Dp75) being 1.0-1.20, wherein Dv75 is 75% volume particle diameter and Dp75 is 75% number particle diameter.

11. The image forming method of claim 7, wherein the binder of the surface layer contains siloxane-modified polycarbonate.

12. The image forming method of claim 7, wherein the binder of the surface layer contains polyarylate resin.

13. The image forming method of claim 12, wherein the polyarylate resin is represented by following formula, (1)

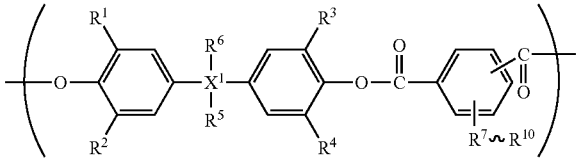

wherein $X^1$ is a carbon atom or a simple bond; $R^1$ through $R^4$ each is a hydrogen or halogen atom, or an alkyl or aryl group which may have a substituent; $R^5$ and $R^6$ each is a hydrogen or halogen atom, or an alkyl or aryl group which may have a substituent, or an alkylidene formed by bonding $R^5$ and $R^6$; $R^7$ through $R^{10}$ is a hydrogen or halogen atom, or an alkyl or aryl group which may have a substituent.

14. The image forming method of claim 7, wherein the photoreceptor comprises a charge generation layer and a plurality of charge transfer layers.

15. The image forming method of claim 14, wherein an outermost charge transfer layer is the surface layer.

16. The image forming method of claim 14, wherein the charge generation layer comprises galliun-phthalocyanine.

17. The image forming method of claim 7, wherein a number average molecular weight of a polymer of the fluorine resin fine particles is 10,000 to 1,000,000.

18. The image forming method of claim 7, wherein the crystallinity of the fluorine resin fine particles is 40% or more.

19. The image forming method of claim 7, wherein the toner comprises a releasing agent represented by Formula:

$$R^1\text{—}(OCO\text{—}R^2)_n$$

wherein n is an integer from 1 to 4, preferably from 2 to 4, and more preferably 3 or 4, $R^1$ and $R^2$ each represents a hydrocarbon group, which may have a substituent.

* * * * *